US011087582B2

(12) United States Patent
Franich et al.

(10) Patent No.: US 11,087,582 B2
(45) Date of Patent: Aug. 10, 2021

(54) ELECTRONIC GAMING MACHINE PROVIDING ENHANCED PHYSICAL PLAYER INTERACTION

(71) Applicant: IGT, Las Vegas, NV (US)

(72) Inventors: Matthew Franich, Reno, NV (US); Jerrod Laputz, Sparks, NV (US); Stewart Thoeni, Reno, NV (US)

(73) Assignee: IGT, Las Vegas, NV (US)

( * ) Notice: Subject to any disclaimer, the term of this patent is extended or adjusted under 35 U.S.C. 154(b) by 182 days.

(21) Appl. No.: 16/165,225

(22) Filed: Oct. 19, 2018

(65) Prior Publication Data

US 2020/0126347 A1 Apr. 23, 2020

(51) Int. Cl.

| | |
|---|---|
| ***G07F 17/00*** | (2006.01) |
| ***G07F 19/00*** | (2006.01) |
| ***G07F 17/32*** | (2006.01) |

(52) U.S. Cl.

CPC ..... *G07F 17/3211* (2013.01); *G07F 17/3216* (2013.01)

(58) Field of Classification Search

CPC ..... G07F 17/3211; G07F 17/3216

See application file for complete search history.

(56) References Cited

U.S. PATENT DOCUMENTS

| | | | | |
|---|---|---|---|---|
| 5,267,221 | A * | 11/1993 | Miller | G10K 11/002 310/327 |
| 9,058,714 | B2 | 6/2015 | Hamlin et al. | |
| 9,612,658 | B2 * | 4/2017 | Subramanian | G06F 3/016 |
| 9,672,689 | B2 | 6/2017 | Idris et al. | |
| 9,895,607 | B2 | 2/2018 | Froy | |
| 9,958,943 | B2 * | 5/2018 | Long | G06F 3/016 |
| 10,013,061 | B2 | 7/2018 | Froy | |
| 10,268,275 | B2 * | 4/2019 | Carter | G06F 3/0488 |
| 2015/0007025 | A1 * | 1/2015 | Sassi | G06F 3/0488 715/702 |
| 2015/0009782 | A1 * | 1/2015 | Engl | G01N 29/221 367/189 |
| 2015/0185841 | A1 * | 7/2015 | Levesque | G06F 1/1639 715/702 |
| 2015/0367586 | A1 * | 12/2015 | Georgeson | B06B 1/0688 367/140 |
| 2016/0175701 | A1 * | 6/2016 | Froy | G06F 3/01 463/32 |
| 2016/0180636 | A1 * | 6/2016 | Froy | G07F 17/3206 463/32 |
| 2017/0123499 | A1 * | 5/2017 | Eid | G10K 15/00 |
| 2017/0285745 | A1 * | 10/2017 | Doran | G06F 3/0416 |
| 2017/0365774 | A1 * | 12/2017 | Rothberg | H05K 3/361 |
| 2018/0078854 | A1 | 3/2018 | Achmueller et al. | |

* cited by examiner

*Primary Examiner* — Milap Shah

(74) *Attorney, Agent, or Firm* — Neal, Gerber & Eisenberg LLP

(57) ABSTRACT

An electronic gaming machine that provides enhanced physical player interaction by employing a player tactile feedback provider including co-acting ultrasonic transducer array assemblies.

13 Claims, 11 Drawing Sheets

ELECTRONIC GAMING MACHINE PROVIDING ENHANCED PHYSICAL PLAYER INTERACTION

BACKGROUND

The present disclosure relates to gaming systems, and more particularly to electronic gaming machines that enable play of wagering games. Electronic gaming machines may include one or more primary wagering games and one or more secondary games. Electronic gaming machines may display objects (such as two or three dimensional objects) that are player selectable as part of a primary wagering game or as part of a secondary game. Electronic gaming machines may provide players various different types of feedback when a player selects such displayed objects (such as two or three dimensional objects).

BRIEF SUMMARY

The present disclosure provides electronic gaming machines that provide enhanced physical player interaction.

In various embodiments, the present disclosure provides an electronic gaming machine including a housing, and a player tactile feedback provider supported by the housing. The player tactile feedback provider includes an ultrasonic transducer array assembly comprising a printed circuit board, a transducer holder tray connected to the printed circuit board, and an ultrasonic transducer supported by the transducer holder tray at an acute angle relative to the printed circuit board and connected to the printed circuit board.

In various other embodiments, the present disclosure provides an electronic gaming machine including a housing, a display device supported by the housing, a player hand position locator supported by the housing, a first ultrasonic transducer array assembly supported by the housing, and a second ultrasonic transducer array assembly supported by the housing. The first ultrasonic transducer array assembly includes a first printed circuit board, and a plurality of first ultrasonic transducers connected to the first printed circuit board and extending at a first acute angle relative to the first printed circuit board. The second ultrasonic transducer array assembly includes a second printed circuit board, and a plurality of second ultrasonic transducers connected to the second printed circuit board and extending at a second acute angle relative to the second printed circuit board.

In various other embodiments, the present disclosure provides an electronic gaming machine including a housing, a display device supported by the housing, a first ultrasonic transducer array assembly supported by the housing, and a second ultrasonic transducer array assembly supported by the housing. The first ultrasonic transducer array assembly includes a first printed circuit board, a first transducer holder tray connected to the first printed circuit board, a plurality of first ultrasonic transducers each supported by the first transducer holder tray at a first acute angle relative to the first printed circuit board and connected to the first printed circuit board. The second ultrasonic transducer array assembly includes a second printed circuit board, a second transducer holder tray connected to the second printed circuit board, a plurality of second ultrasonic transducers each supported by the second transducer holder tray at a second acute angle relative to the second printed circuit board and connected to the second printed circuit board. The first ultrasonic transducer array assembly and the second ultrasonic transducer array assembly are configured to direct sound waves into respective player tactile feedback zones that are partially overlapping in front of and spaced apart a designated distance from the display device, the designated distance based on a 3D object display area in front of the display device.

Additional features are described in, and will be apparent from, the following Detailed Description and the Figures.

DETAILED DESCRIPTION

The present disclosure provides new electronic gaming machines ("EGMs") and methods of operating such new EGMs. For brevity and clarity, and unless specifically stated otherwise, the term "EGM" is used herein to refer to an electronic gaming machine (such as but not limited to a slot machine, a video poker machine, a video card machine, a video lottery terminal ("VLT"), a video keno machine, a video bingo machine, and a sports betting terminal). For brevity, the term "3D image(s)" used herein includes any three dimensional ("3D") image or 3D images or other content shown in 3D such as but not limited to moving or transforming 3D geometries, 3D videos, or 3D movies, etc.

In various example embodiments of the present disclosure, the EGM includes: (1) a display device configured to display 3D images such as 3D objects to a player (with or without requiring the player to wear 3D glasses); (2) a player hand position locator configured to determine the positions of one of the player's hand in a 3D object display area that is in front of and spaced apart from the display device; and (3) a player tactile feedback provider configured to provide tactile feedback to the player's hand in the 3D object display area based on the determined position(s) of the player's hand. In various other embodiments, the player hand position locator is configured to determine the positions of each of the player's hands in a 3D object display area; and the player tactile feedback provider is configured to provide tactile feedback to each of the player's hands in the 3D object display area based on those determined positions of the player's hands. For purposes of this disclosure, the embodiment that determines the positions of one of the player's hands and that provides player tactile feedback to that player hand is primarily described herein for brevity.

Figure 9:
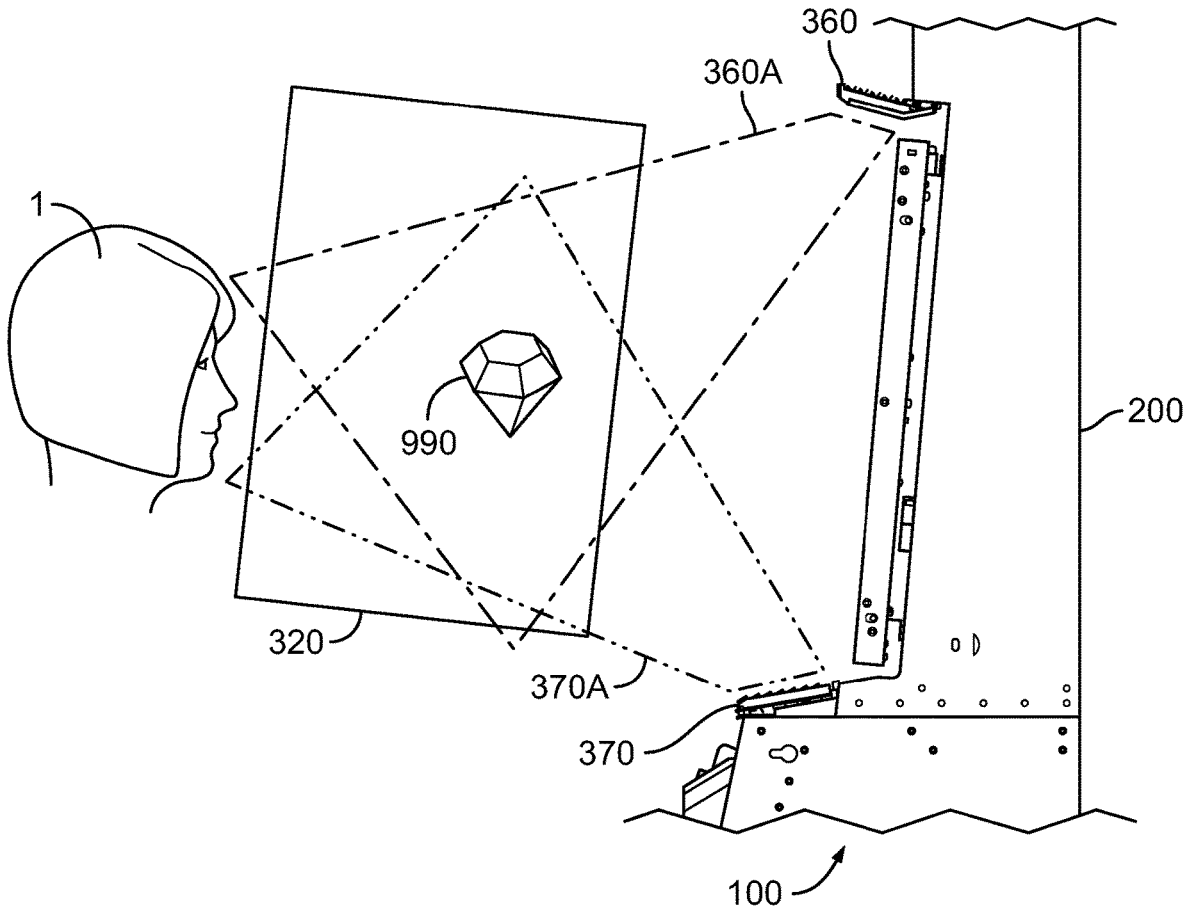
FIG. 9 is an enlarged fragmentary side view of the central portion of the electronic gaming machine of FIG. 1, shown with certain components removed, showing an upper player tactile feedback zone provided by the upper ultrasonic transducer array assembly, showing a lower player tactile feedback zone provided by the lower ultrasonic transducer array assembly, and showing the 3D object display area of the electronic gaming machine of FIG. 1.

In various such embodiments, the player tactile feedback provider includes: (1) a first (such as an upper) ultrasonic transducer array assembly that is configured to provide player tactile feedback in a first (such as an upper) player tactile feedback zone; and (2) a second (such as a lower) ultrasonic transducer array assembly that is configured to provide player tactile feedback in a second (such as a lower) player tactile feedback zone. In various embodiments, the first (or upper) player tactile feedback zone and the second (or lower) player tactile feedback zones partially overlap and partially do not overlap as generally shown in FIG. 9 and as further described below. In various embodiments, the first (or upper) ultrasonic transducer array assembly and the second (or lower) ultrasonic transducer array assembly are configured to co-act to provide the player tactile feedback to a player's hand in an exact area in the 3D object display area in which one or more 3D images such as one or more 3D objects are displayed. In various embodiments, the first (or upper) ultrasonic transducer array assembly and the second (or lower) ultrasonic transducer array assembly are vertically aligned to co-act to provide the player tactile feedback. In various embodiments, the first (or upper) ultrasonic transducer array assembly and the second (or lower) ultrasonic transducer array assembly are vertically offset to co-act to provide the player tactile feedback.

In various embodiments of the present disclosure, the EGM causes the player tactile feedback provider to produce one or more tactile sensations to the player's hand on a real time (or substantially real time basis) to give the player the sensation that the player is actually touching (and interacting with) the displayed 3D object. In various embodiments of the present disclosure, the EGM can provide the enhanced physical player interaction in conjunction with one or more various displayed 2D or 3D objects that are in the form of one or more game components (such as but not limited to game symbols, game cards, game reels, game wheels, game tiles, game dice, game chips, game balls, game selections, game characters, game awards, game outcomes, or other game objects).

Certain of the components of the EGM of the present disclosure including those that co-act to provide the enhanced physical player interaction provided by the EGM are first discussed below under the EGM—ENHANCED PHYSICAL PLAYER INTERACTION PRIMARY COMPONENTS section heading. The various other components that can be provided with the EGM of the present disclosure are then subsequently discussed below under the EGM—GENERAL COMPONENTS AND OPERATION section heading. These headings are not meant to limit the scope of the present disclosure in any manner. It should also be appreciated that the present disclosure can be used in other suitable machines.

I. EGM—Enhanced Physical Player Interaction Primary Components

Referring now to FIGS. 1, 2, 3, 4, 5, 6, 7, 8, and 9, one example EGM of the present disclosure is generally illustrated and indicated by numeral 100. The example EGM 100 generally includes a housing 200 that supports a plurality of output devices and a plurality of input devices of the EGM 100, among other components. In this illustrated example embodiment, the plurality of output devices includes: (1) a first (intermediate) display device 300; (2) a second (upper) display device 400 positioned above the first display device 300; and (3) a third (lower) display device 500 positioned below the first display device 300. These display devices 300, 400, and 500 are configured to display the games, game outcomes, awards (such as the primary and secondary games awards or other game outcome awards), and other functionality and information to the player(s). Such output devices can also include one or more of the output devices described below in the second section of this detailed description. In this illustrated example embodiment, the plurality of player input devices (such as input devices 600 and 610) enable the player to play one or more wagering games provided by the EGM 100. Such player input devices can also include one or more of the input devices described below in the second section of this detailed description. These example player input devices are physically activatable by the player to enable the player to make inputs into the EGM 100. These output devices and input devices are configured such that a player may operate the EGM 100 while standing or sitting, but preferably operates the EGM 100 while the player is sitting in front of the EGM 100 such that the player's head is approximately at the same height as the first display device 300 (as generally shown in FIG. 9).

In this illustrated example embodiments, the EGM 100 includes: (1) the first display device 300 that is configured to display three-dimensional ("3D") images (such as the 3D object 990 shown in FIG. 9) to the player (such as to player 1 shown in FIG. 9) without requiring the player to wear 3D glasses; (2) a player hand position locator (not shown) that is configured to track the positions of one (or both) of the player's hands in the 3D object display area 320 that is in front of and spaced apart from the first display device 300; (3) a player tactile feedback provider including an upper ultrasonic transducer array assembly 360 and a lower ultrasonic transducer array assembly 370 that are configured to co-act to provide player tactile feedback to one (or both) of the player's hands in the exact area of the 3D object display area 310 in which the 3D object is displayed (which is a designated distance away from or transverse to the front of the display device 300).

It should be appreciated that for various such display devices 300 that are configured to display 3D objects without the player wearing 3D glasses, that the devices will display such objects in a manner that appear to the player to be spaced from the front of the display device at least 8 inches from the front of the display device.

In this illustrated example embodiment, the EGM 100 also includes one or more processors (not shown in FIGS. 1 to 9) and one or more memory devices (not shown in FIGS. 1 to 9) that co-act or work together with the above mentioned components to provide the enhanced physical player interaction. It should be appreciated that: (1) the first display device; (2) the player hand position locator; and (3) the player tactile feedback provider, may each be individually configured or may alternatively be configured to operate with the one or more processors and memory devices to provide each of their designated functions described herein. In other words, (1) the first display device may be individually configured to display the 3D images or may be configured to operate with the one or more processors and memory devices to display the 3D images; (2) the player hand position locator may individually be configured to track the position(s) of one (or both) of the player's hands or may be configured to operate with the one or more processors and memory devices to track the position(s) of one (or both) of the player's hands; and (3) the player tactile feedback provider may be individually configured to provide tactile feedback to one (or both) of the player's hands or may be configured to operate with one or more processors and memory devices to provide tactile feedback to one (or both) of the player's hands. Thus, for purposes of this disclosure and for brevity, each of these devices are sometimes discussed as performing such tasks individually or operating with the one or more processors and memory devices to perform such tasks, and such descriptions are not intended to limit the present disclosure to either configuration.

In certain modes of operation, the first display device, the player hand position locator, the player tactile feedback provider, the processor(s), and the memory device(s) are configured to provide the enhanced physical player interaction of the present disclosure by operating on a real time (or substantially real time basis) to: (1) cause the first display device to display a 3D object such that the player in front of the first display device can see the displayed 3D object in the 3D object display area 320; (2) determine the positions of one of the player's hands positioned relative to the displayed 3D object in the 3D object display area 320; (3) enable the player to interact with the displayed 3D object; and (4) cause one or both of the upper ultrasonic transducer array assembly 360 and the lower ultrasonic transducer array assembly 370 to provide player tactile feedback to the player's hand in the exact area at which the 3D object is displayed in the 3D object display area 320 in front of the EGM 100, thus giving the player a sense that the player actually touched the displayed 3D object as if the displayed 3D object was a physical object. In various embodiments, this physical interaction is provided by one or more choreographed haptic events that the player can physically feel on the player's hand (such as one or more fingers of that player hand). The choreographed haptic event(s) include one or more sound waves directed at the player's hand in the 3D object display area 320 that provide the player a feeling that the player is actually touching the displayed 3D object in the 3D object display area 320.

In this illustrated example embodiment, the first display device 300 of the EGM 100 that is configured to display the 3D object to the player without requiring the player to wear 3D glasses includes one or more lenticular lenses (not shown). In various embodiments, the first display device 300 including the lenticular lense(s) is configured to display what appears to the player as a 3D object in the 3D object display area 320. As indicated above, it should also be appreciated that other suitable 3D objects may be displayed and the 3D object display apparatus may vary in accordance with the present disclosure.

In this illustrated example embodiment, the player hand position locator of the EGM 100 that is configured to track or determine the position(s) of one of the player's hands in the 3D object display area 320 in front of the first display device 300 includes a plurality of cameras generally indicated by numerals 330 and 340 that are supported by the housing 200 and positioned adjacent to the first display device 300. In this illustrated embodiment, one camera 330 is positioned directly to the right of the display device 300 (looking forward) and one camera 340 positioned directly to the left of the display device 300 (looking forward). In this illustrated embodiment, the plurality of cameras 330 and 340 are positioned adjacent to an upper right hand corner of the display device 300 and the other of the plurality of camera is positioned adjacent to an upper left hand corner of the display device 300. It should be appreciated that in an alternative embodiment, the plurality of cameras can be positioned adjacent to a lower right hand corner of the display device 300 and positioned adjacent to a lower left hand corner of the display device 300. It should be appreciated that in other alternative embodiments, the plurality of cameras can be otherwise alternatively positioned in accordance with the present disclosure. It should also be appreciated that in other alternative embodiments, the EGM can include only one such camera or more than two such cameras in accordance with the present disclosure. In various embodiments, the player hand position locator is configured to locate part of the player's hand, such as one or more fingers. In various embodiments, the player hand position locator is configured to simultaneously locate both of the player's hands or locate multiple parts of the player's hands, such as two or more fingers.

In various example embodiments, the cameras 330 and 340 include time of flight depth camera sensors positioned at the two opposite sides of the display device 300 and focused inwardly somewhat towards each other. In various example embodiments, the time of flight depth camera sensors make the EGM 100 less prone to occlusions. In various example embodiments, the time of flight depth cameras also deliver point clouds that can be quickly analyzed and used by the processor(s) to make the necessary determinations. It should be appreciated that other suitable depth sensors (other than time of flight sensors) may be employed in accordance with the present disclosure.

In various embodiments, the EGM 100 uses the image data provided by the cameras 330 and 340 to determine the position(s) of one (or both) of the player's hand(s) relative to the displayed 3D object. In certain embodiments, the EGM 100 creates the object depth images using point clouds provided by time of flight depth cameras and merges these point clouds to create one optimized point cloud that represents the object(s), such as the player's hand(s) relative to the display device 300. This provides a high degree of accuracy and a relatively large coverage area (then would a one camera system). In these embodiments, the EGM 100 determines in real time or substantially real time the position(s) of the object(s) such as the player's hand(s), and uses the determined position(s) for providing the tactile feedback to the player in real time (or substantially real time).

Using these two cameras and keeping the camera resolution relatively low: (a) facilitates an increased size of the 3D object display area; and (b) reduces the need for high data rates and significant processing time or delays for image analysis that may slow down the EGM 100 and prevent real time (or substantially real time) physical player feedback or sensation. Using these two cameras also better facilitates the tracking of multiple player hands.

In various other embodiments, the EGM 100 uses the image data provided by the cameras 330 and 340 to determine the closest depth of the end of one of the player's hand(s) (such as the end of one of the player's fingers) that is in the 3D object display area 320 closest to the display device 300. In other words, in these alternative embodiments, the EGM 100 determines the nearest point (i.e., the xyz coordinate relative to the display device 300) of the player's hand in the 3D object display area 320 closest to the display device 300, and then uses that point as the reference for providing the tactile feedback to the player in real time (or substantially real time).

In various other embodiments, the EGM uses the image data provided by the cameras 330 and 340 to determine movements (such as gestures) by the player's hand(s). In these embodiments, the EGM 100 uses the determined movements to provide the tactile feedback to the player in real time (or substantially real time).

In certain embodiments, the EGM 100 includes one or more camera sync cables (not shown) that sync the multiple cameras 330 and 340 to enhance the accuracy of the determination of the position(s) of player's hand(s). It should be appreciated that the image data from the multiple cameras can be synced in other suitable manners in accordance with the present disclosure.

It should also be appreciated that other suitable player hand position locating systems or devices can be employed in accordance with the present disclosure. For example, in various other embodiments, the player hand position locator actually estimates the hand pose. The pose of the hand is not the position of the hand, but is instead the location and orientation of certain bones or every bone of the hand. In certain embodiments, the hand pose is determined by determining or specifying the 3D coordinates of a plurality of or every joint of the skeleton hand.

In the illustrated example embodiment, the player tactile feedback provider of the EGM 100 that is configured to provide tactile feedback to one (or both) of the player's hands includes two spaced apart ultrasonic transducer array assemblies 360 and 370 attached to and supported by the housing 200, and positioned directly below and above the first display device 300, respectively. The first (upper) ultrasonic transducer array assembly 360 is configured to selectively produce and direct sound waves into a first player tactile feedback zone 360A as shown in FIG. 9 from above the first display device 300. The second (lower) ultrasonic transducer array assembly 370 is configured to selectively produce and direct sound waves into a second player tactile feedback zone 370A as shown in FIG. 9 from below the first display device 300. In this illustrated embodiment, the first player tactile feedback zone 360A and the second player tactile feedback zone 370A primarily overlap, but each includes non-overlapping areas as generally shown in FIG. 9. The EGM 100 uses the ultrasonic transducer array assemblies 360 and 370 to selectively produce and send the directed sound waves into the 3D object display area 320 at the determined position of the player's hand in the 3D object display area 320 to cause the players' hand to feel one or more pulses of the sound waves produced by such devices on a real time (or substantially real time basis). The first player tactile feedback zone 360A and the second player tactile feedback zone 370A are primarily spaced from the front of the display device 300 to be better coordinated with and aligned with the 3D object display area 320 (than prior known EGMs) as further discussed below.

The example EGM 100 uses the ultrasonic transducer array assemblies 360 and 370 to produce and send directed sound waves into the 3D object display area 320 at the determined position of the player's hand when the player's hand is at the same position or area of the displayed 3D object in the 3D object display area 320 such that the sound waves reaching the player's hand at that position provide the player the sensation that the player is actually touching (and interacting with) the displayed 3D object as if each such object was an actual physical object floating in the 3D object display area 320 in front of the player. This sensation can occur when the player interacts with displayed 3D object apparently in midair in the 3D object display area 320. Thus, the EGM 100 can simulate a characteristic of the displayed 3D object the player appears to be interacting with.

The EGM 100 is configured to cause the ultrasonic transducer array assemblies 360 and 370 to individually or jointly produce and send continuous, regular, interrupted, directed, and/or individual sound waves into the respective first player tactile feedback zone 360A as shown in FIG. 9 and the second player tactile feedback zone 370A to cause the players' hand to feel such sound waves. In various embodiments, the EGM 100 is configured to cause the ultrasonic transducer array assemblies 360 and 370 to vary the intensity of the sound waves at the determined positions of the player's hand in the 3D object display area 320 to cause the players' hand to feel different sensations.

In various embodiments, at the same time or slightly after the EGM 100 creates the physical interaction with the player's hand, the EGM 100 is configured to cause the display device 300 to alter the image of the displayed 3D object (such as but not limited to changing the color of the displayed 3D object). This can be used to show one or more responses of the displayed 3D object to the interaction with the player's hand(s).

In various embodiments, the EGM 100 captures the player's hand midair location coordinates while performing a movement in the 3D object display area 320 in real-time, provides haptic sensation to the player's hand at these coordinates in the 3D object display area 320 with no or little lag time, and can additionally alter the displayed 3D object in real time.

In this illustrated example embodiment, the two ultrasonic transducer array assemblies 360 and 370 are identical but positioned and attached to the housing 200 in different opposing orientations. Specifically, ultrasonic transducer array assembly 360 is positioned in a downwardly facing position and ultrasonic transducer array assembly 370 is positioned in an upwardly facing assembly. In this illustrated example embodiment, the first (or upper) ultrasonic transducer array assembly 360 and the second (or lower) ultrasonic transducer array assembly 370 are vertically offset. As mentioned above, in other embodiments, the first (or upper) ultrasonic transducer array assembly and the second (or lower) ultrasonic transducer array assembly are vertically aligned to co-act to provide the player tactile feedback. Since these ultrasonic transducer array assemblies 360 and 370 are identical, only ultrasonic transducer array assembly 370 is described in detail herein. It should be appreciated that the ultrasonic transducer array assemblies 360 and 370 do not need to be identical in accordance with the present disclosure.

Figure 1:
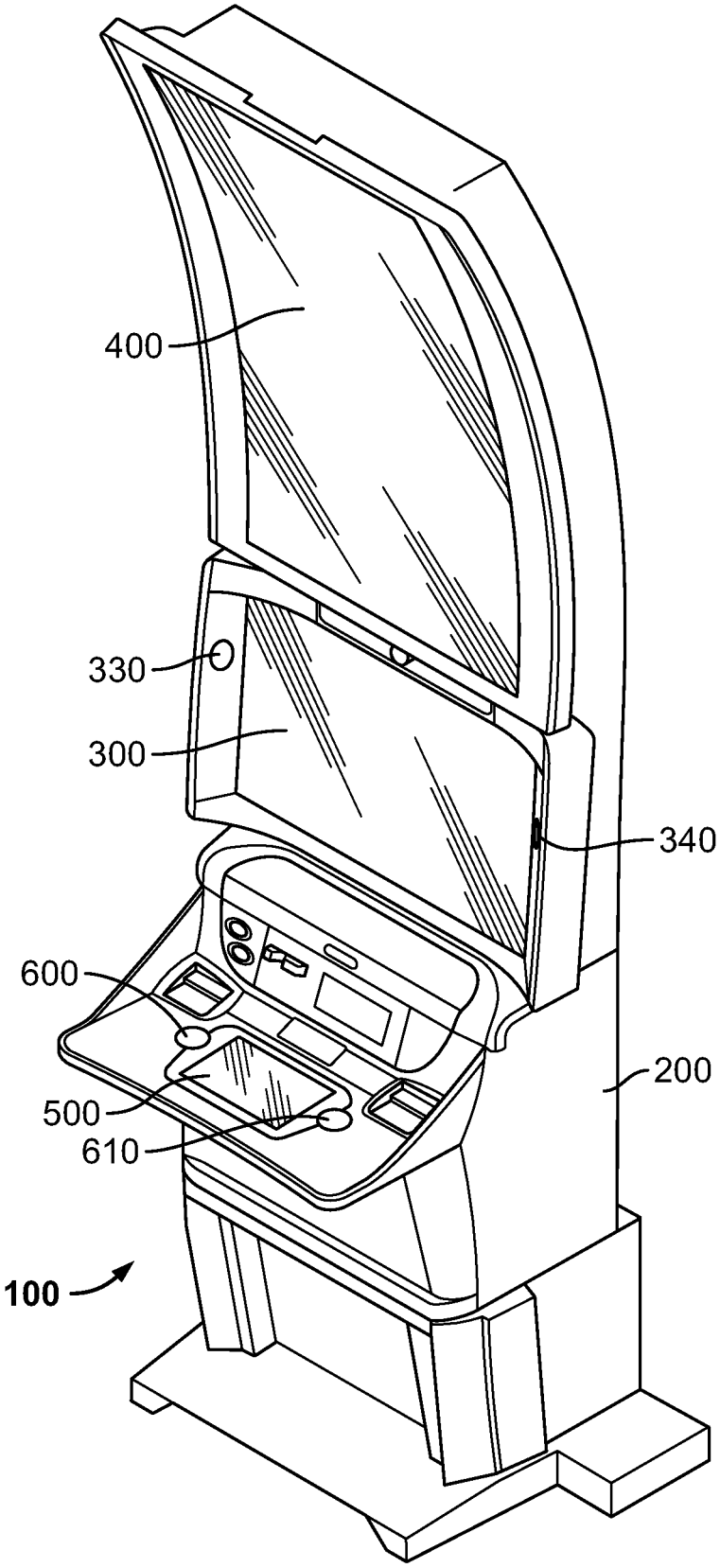
FIG. 1 is a front perspective view of an electronic gaming machine of one example embodiment of the present disclosure.
Figure 2:
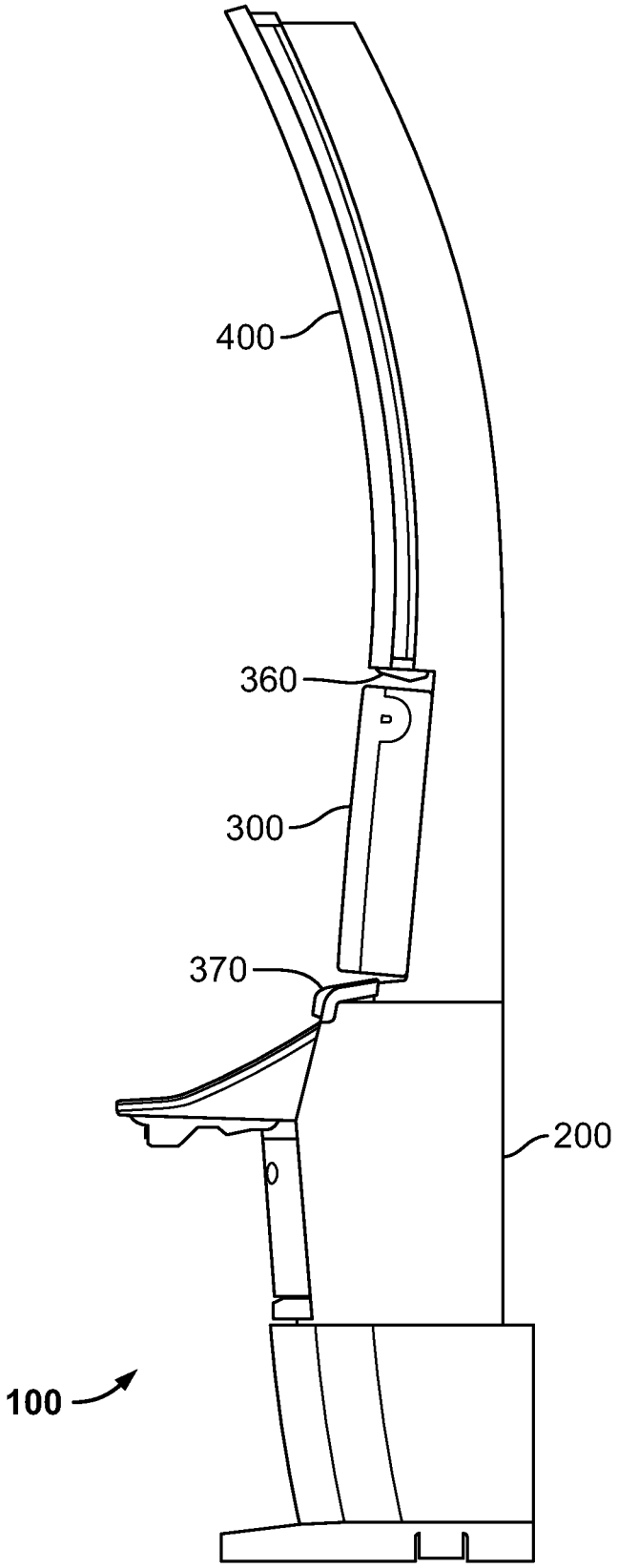
FIG. 2 is a side view of the electronic gaming machine of FIG. 1.
Figure 3:
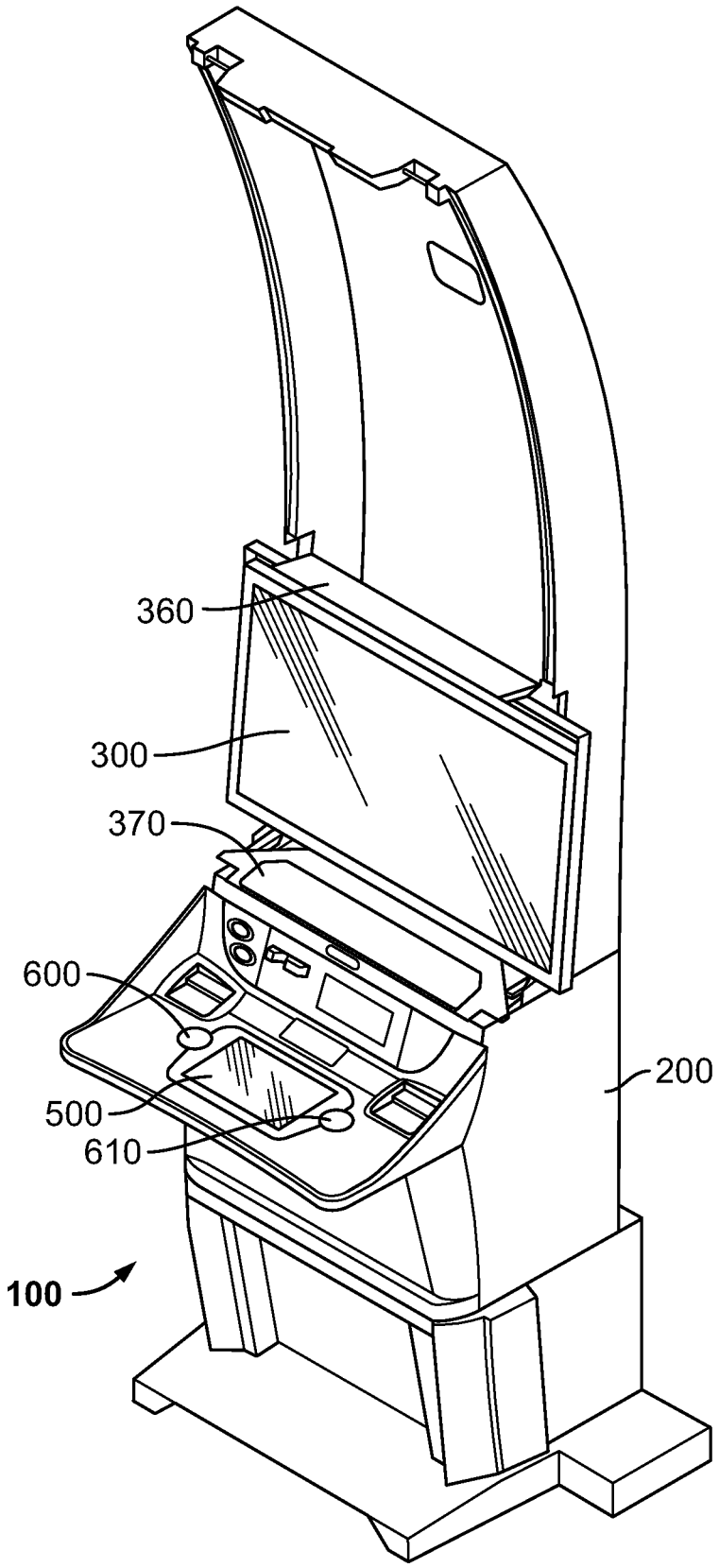
FIG. 3 is a front perspective of the electronic gaming machine of FIG. 1, shown with certain components removed, and showing the upper and lower ultrasonic transducer array assemblies of the player tactile feedback provider of the electronic gaming machine of FIG. 1.
Figure 4:
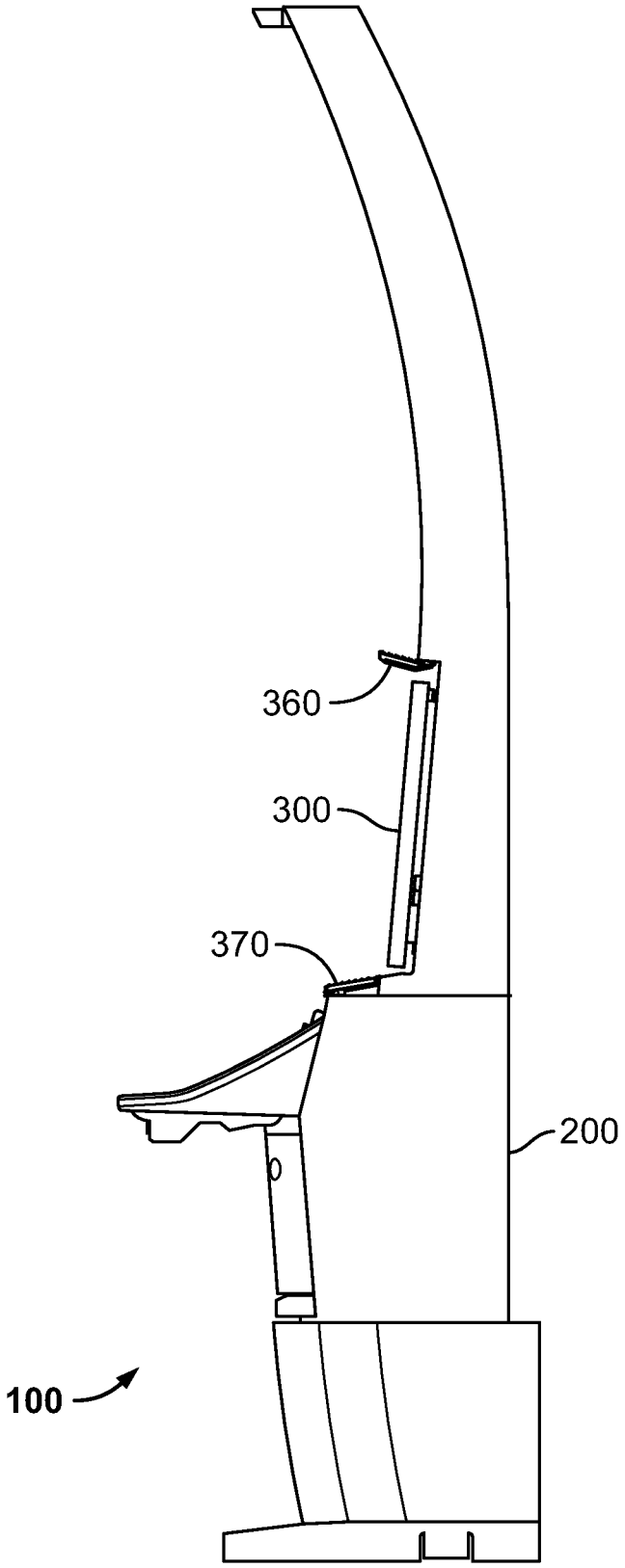
FIG. 4 is a side view of the electronic gaming machine of FIG. 1, shown with certain components removed, and showing the upper and lower ultrasonic transducer array assemblies of the player tactile feedback provider of the electronic gaming machine of FIG. 1.
Figure 5:
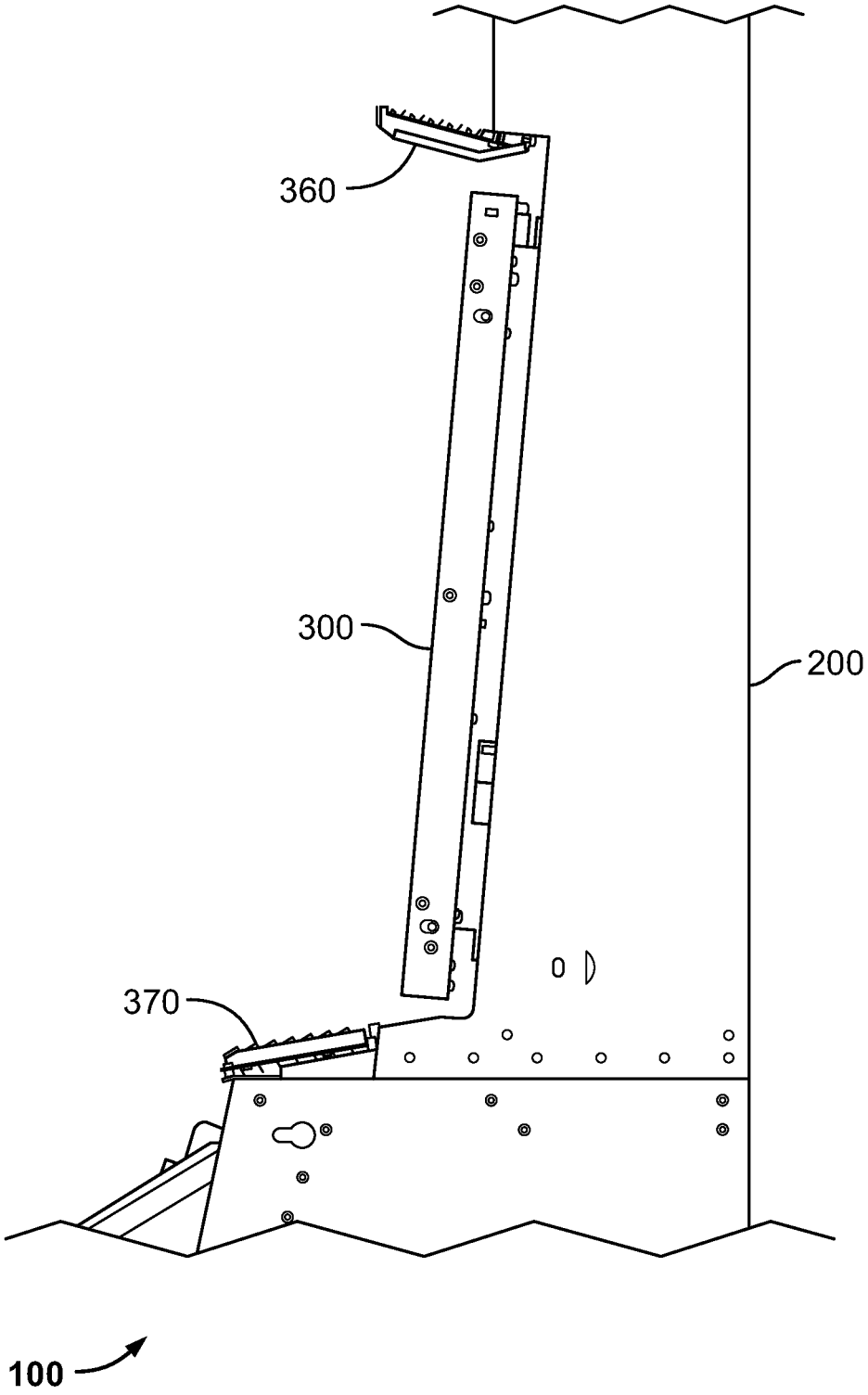
FIG. 5 is an enlarged fragmentary side view of the central portion of the electronic gaming machine of FIG. 1, shown with certain components removed, and showing the upper and lower ultrasonic transducer array assemblies of the player tactile feedback provider of the electronic gaming machine of FIG. 1.
Figure 6:
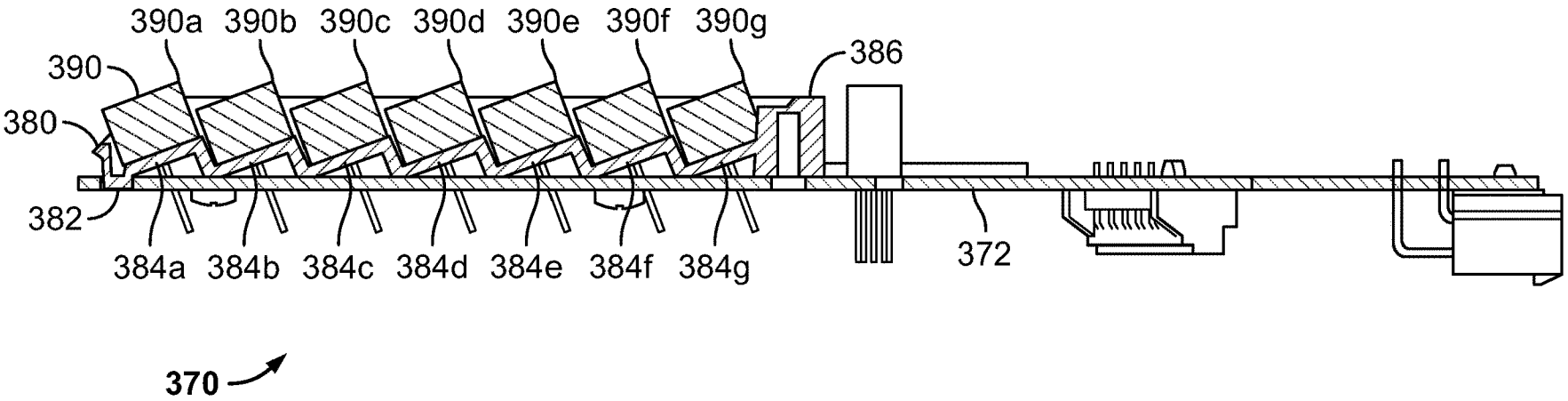
FIG. 6 is an enlarged cross sectional view of the lower ultrasonic transducer array assembly of the player tactile feedback provider of the electronic gaming machine of FIG. 1.
Figure 7:
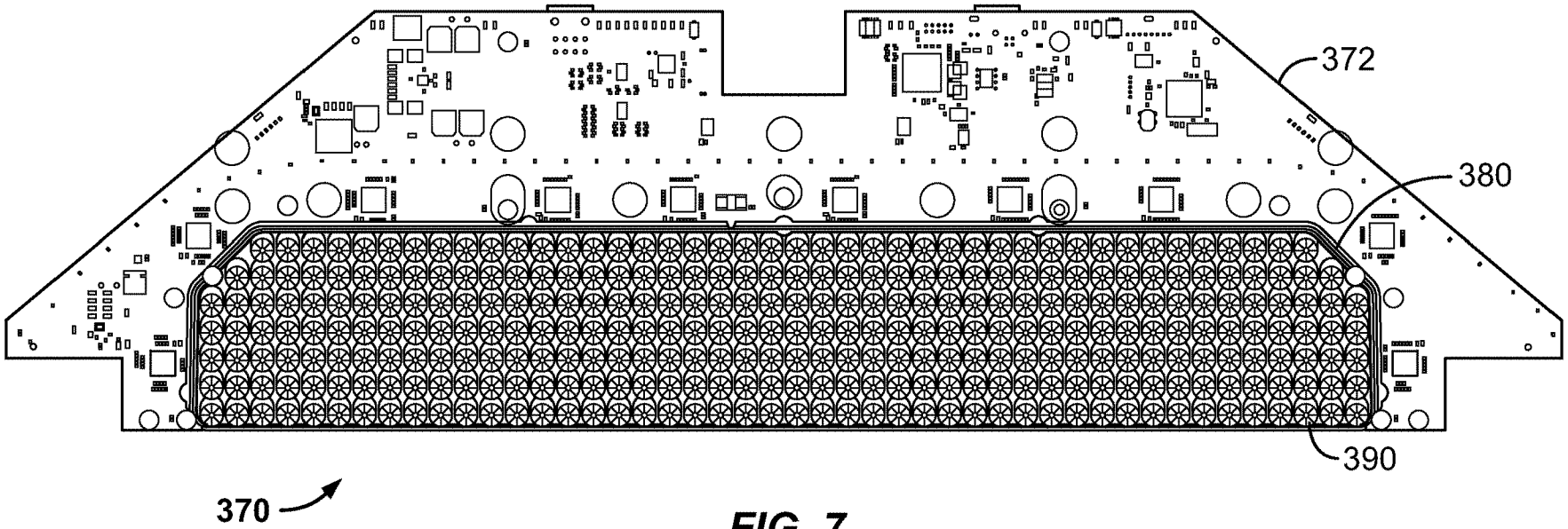
FIG. 7 is an enlarged top view of the lower ultrasonic transducer array assembly of the player tactile feedback provider of the electronic gaming machine of FIG. 1.
Figure 8:
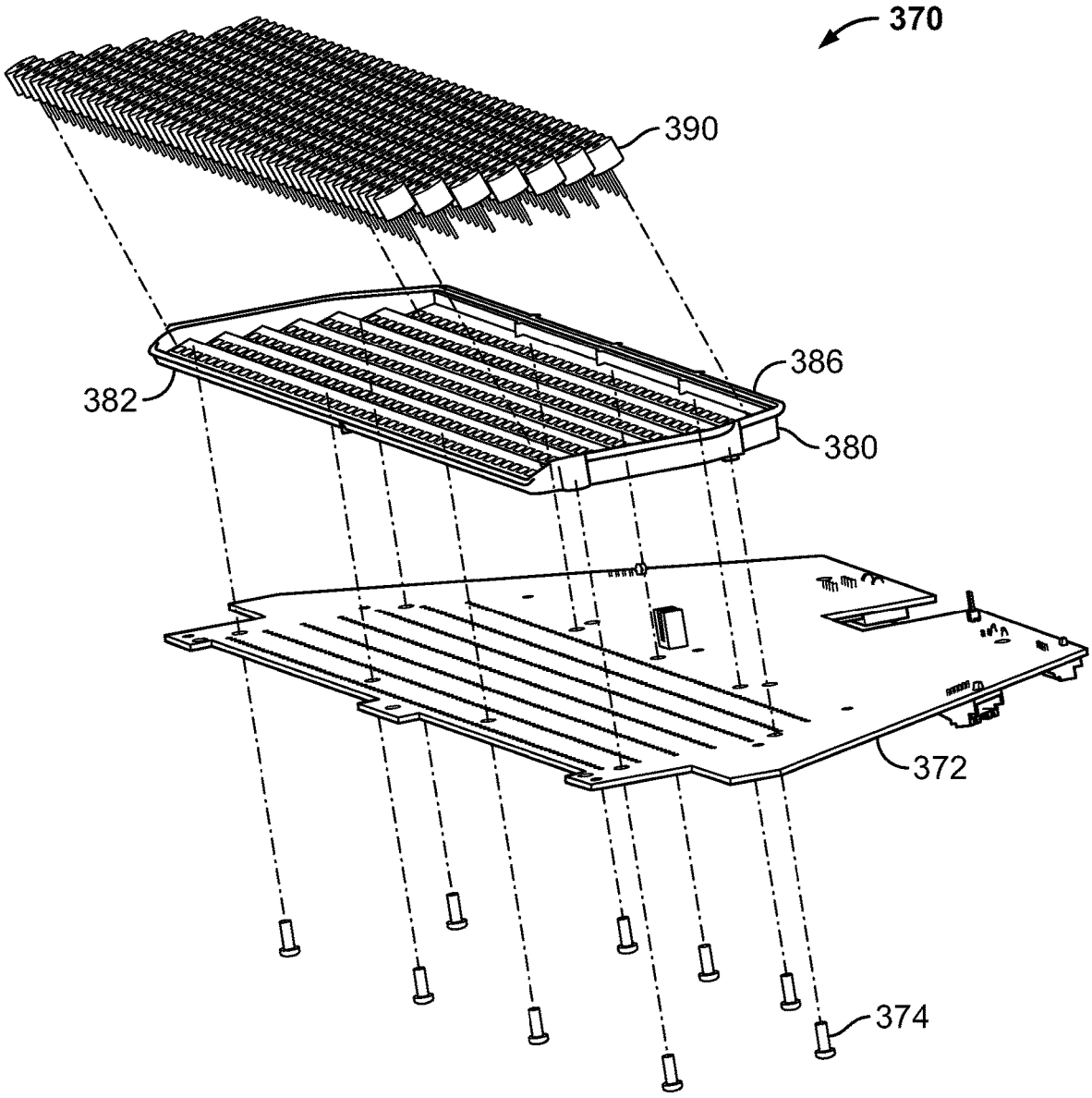
FIG. 8 is an enlarged exploded perspective view of the lower ultrasonic transducer array assembly of the player tactile feedback provider of the electronic gaming machine of FIG. 1.

As best shown in FIGS. 6, 7, and 8, ultrasonic transducer array assembly 370 includes: (1) a printed circuit board ("PCB") 372; (2) a transducer holder tray 380 connected to the PCB 372; and (3) a plurality of ultrasonic transducers 390 (not individually labeled) supported by the transducer holder tray 380 and connected to the PCB 372.

The plurality of ultrasonic transducers 390 (that are not individually labeled) are arranged in transducer rows 390*a*, 390*b*, 390*c*, 390*d*, 390*e*, 390*f*, and 390*g* on the transducer holder tray 380. This illustrated example embodiment includes over 300 ultrasonic transducers, although it should be appreciated that the quantity of ultrasonic transducers may vary in accordance with the present disclosure. In this illustrated example embodiment, the array of ultrasonic transducers 390 is approximately 3 inches by 19 inches, although it should be appreciated that the size and shape of the array of ultrasonic transducers may vary in accordance with the present disclosure.

The example transducer holder tray 380 is a single plastic molded piece and is configured to support the individual ultrasonic transducers 390 (and specifically support each of the ultrasonic transducers 390 in each of transducer rows 390*a*, 390*b*, 390*c*, 390*d*, 390*e*, 390*f*, and 390*g*) at an acute angle relative to the PCB 372. The transducer holder tray 380 includes a base 382 and a rim 386 connected to and extending from the base 382. The transducer holder tray 380 includes a plurality of individual transducer holders 384 (not individually labeled) that are connected to the base 382 and arranged in rows of individual transducer holders 384*a*, 384*b*, 384*c*, 384*d*, 384*e*, 384*f*, and 384*g* connected to the base 382. The individual transducer holders 384 and the rows of individual transducer holders 384*a*, 384*b*, 384*c*, 384*d*, 384*e*, 384*f*, and 384 are each positioned at an inclined acute angle relative to the PCB 372 to support each of the individual transducers 390 at a designated acute angle relative to the PCB 372. In other words, each individual ultrasonic transducer holder 384 is positioned at an acute angle relative to the PCB 372. This enables the ultrasonic transducers 390 to be directed in a direction other than perpendicular to the PCB 372.

It should be appreciated while in this illustrated example embodiments, each individual transducer holder 384 is configured to support the respective ultrasonic transducers at a same acute angle relative to the PCB 372, two or more of the individual transducer holders 384 can alternatively be configured to support the respective ultrasonic transducer at different acute angles relative to the PCB 372. It should further be appreciated while in this illustrated example embodiments, each row of transducer holders is configured to support the respective ultrasonic transducers at a same acute angle relative to the PCB 372, two or more of the rows of transducer holders 384 can alternatively be configured to support the respective ultrasonic transducers at different acute angles relative to the PCB 372.

In the illustrate example embodiment, the transducer holder tray 380 is thus configured to support the transducers 390 (including each of the rows of transducers 390*a*, 390*b*, 390*c*, 390*d*, 390*e*, 390*f*, and 390*g*) at an acute angle relative to the PCB 372 such that when the ultrasonic transducer array assembly 370 is attached to the housing 200, the transducers 390 of the ultrasonic transducer array assembly 370 are suitably angled away from, transverse to, and at a designated distance from the front of the display device 300. This enables the second player tactile feedback zone 370A to be spaced apart from the front of the display device 300.

More specifically, this angled configuration enables the ultrasonic transducers 390 of the second (lower) transducer array assembly 370 to produce sound waves in the second player tactile feedback zone 370A shown in FIG. 9. Likewise, this angled configuration in also employed for the ultrasonic transducers 390 of the first (upper) transducer array assembly 360 (albeit—in an upside down position) to produce sound waves in the first player tactile feedback zone 360A shown in FIG. 9. These configurations enable these zones to be further away from the front face of the first display device 300 (than in prior known EGMs). These configurations also enable the sound waves from these ultrasonic transducers to be better aligned with the displayed 3D object in 3D object display zone 320 (than in prior known EGMs). In other words, when part of the player's hand such as a player's finger is in the exact area where the 3D object is displayed (which is also spaced from the front of the display device 300), the sound waves are directed to the player's finger such that the tactile player sensation is more aligned with the area in which the 3D object is displayed.

FIG. 9 illustrates one example operation of the EGM 100 showing how this embodiment of the present disclosure overcomes this problem. FIG. 9 shows the EGM 100 displaying a 3D player selectable virtual object 990 in the 3D object display area in front of the display device 300 prior to a player hand it. Of course, it should be appreciated that this object 990 is not real, but rather what a player would see looking at the first display device 300. When the player's hand (not shown) such as a finger (not shown) of the player's hand touches the displayed 3D object 990 and is this selected by the player, and ultrasound transducer array assemblies 360 and 370 will produce sound waves that are directed at the area of the displayed 3D object 990 to cause the player to feel one or more sensations of the player touching the displayed 3D object 990.

Figure 10:
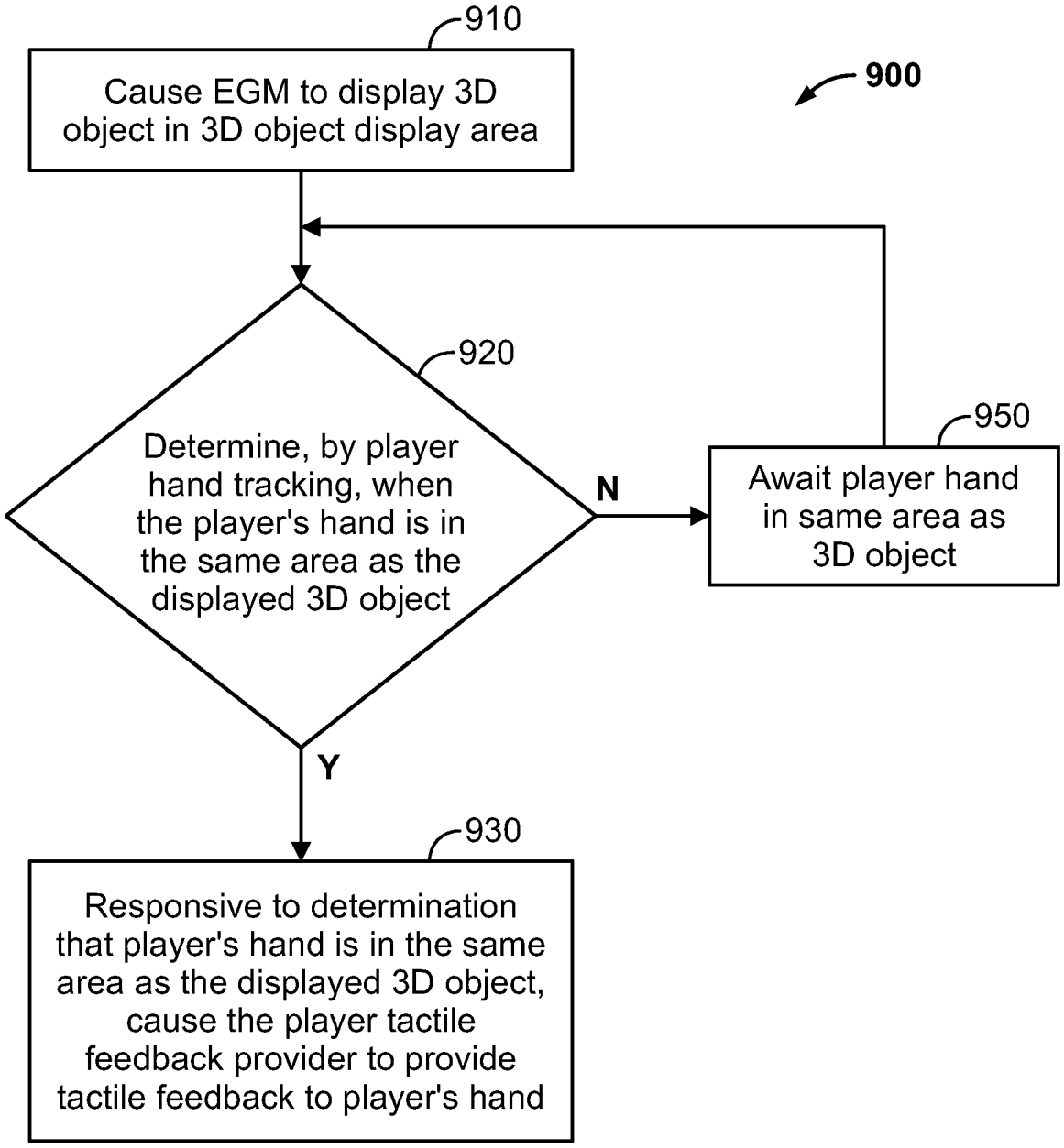
FIG. 10 is a flowchart of one example embodiment of a method of operating an example electronic gaming machine disclosed herein.

Referring now to FIG. 10, FIG. 10 is a flowchart of one example method of operating the EGM of the present disclosure. In various embodiments, the method 900 is represented by a set of instructions stored in one or more memories and executed by one or more processors. Although the method 900 is described with reference to the flowchart shown in FIG. 10, many other processes of performing the acts associated with this illustrated process may be employed. For example, the order of certain of the illustrated blocks or diamonds may be changed, certain of the illustrated blocks or diamonds may be optional, or certain of the illustrated blocks or diamonds may not be employed. This example method 100 generally includes: (1) causing a display device 300 of the EGM 100 to display a player selectable object (such as a 3D image of a selectable object 990) in the 3D object display area 320 as indicated by block 910; (2) determining, by a player hand tracker, when the player placed the player's hand in the specific area of the displayed object 990 as indicated by diamond 920; and (3) responsive to the determination that the player has placed the players hand at the area of the displayed object, cause the player tactile feedback provider (and specifically ultrasonic transducer array assemblies 360 and 370) to provide haptic tactile feedback to the player's hand at the specific location of the displayed 3D object as indicated by block 930. As indicated by block 950, if the player has not selected the displayed object, the EGM awaits player section of the displayed 3D object for a period of time, or can perform another function (not shown in FIG. 9).

The present disclosure thus overcomes the problems with various known EGMs that display a 3D object a certain distance from the front face of the display screen of the 3D display device, but provide the sound waves at a position closer to the front face of the display screen than at which the 3D object appears to be displayed. In these prior known EGMs, the transducers are soldered directly to the printed circuit board at a direction perpendicular to the printed circuit board. In these prior known EGMs, the player tactile feedback provided by the EGMs is thus offset from and not aligned with the displayed 3D object, and thus provides an uncoordinated experience for the player. Thus, in various known EGMs, when it appears to the player's eyes that the player's hand is touching the displayed 3D object, the player's hand does not feel the sounds wave until the player's hand moves much closer to the display device (and thus beyond the displayed 3D object). To fix this problem, the circuit board could be mounted at a more angled position, but this would require the display device to be mounted in a less than ideal position and thus reduce player ergonomics. The present disclosure alternatively overcomes this problem by enabling the ultrasonic transducer array to be better angled toward the 3D object display area 320 without having to rotate the mounting position of the printed circuit board and thus without having to reposition the display device in a less than ideal position for player ergonomics.

It should be appreciated from the above that in various embodiments, the EGM can provide the enhanced physical player interaction in conjunction with game play or other functionality provided by the EGM 100 to the player. For example, the EGM 100 can provide interaction with: (a) one or more fingertips of the player interacting in midair in the 3D object display area 320 that enables the player to make inputs such as drawing letters, symbols, or other images with controlled sensational feedback; or (b) one hand or two hands of the player interacting in midair in the 3D object display area 320 the player to make inputs such as drawing letters, symbols, or other images with controlled sensational feedback.

In various other example embodiments, the EGM 100 can provide the enhanced physical player interaction in conjunction with other functionality provided by the EGM 100 to the player. For example, the EGM 100 can display virtual images of a series of drinks in the 3D object display area 320 and enable to player to select one of the virtual images. When the player positions the player's hand at the position of the selected drink, the EGM 100 can use the ultrasonic transducer array assemblies to provide feedback or sensation to the player's hand indicating that that drink has been selected by the player.

It should be appreciated that in other example embodiments, only one of the two ultrasonic transducer array assemblies 360 and 370 is employed in the EGM. It should be appreciated that in other example embodiments, one or more of the ultrasonic transducer array assemblies 360 and 370 are positioned on the sides of the display device 300 of the EGM 100. It should be appreciated that in other example embodiments, more than two ultrasonic transducer array assemblies are employed in the EGM 100.

In various example embodiments, the EGM 100 includes one or more audible sound producing devices (such as speakers) that produce sounds that are coordinated with the haptic tactile feedback provided to the player by the EGM 100 to further enhance the physical player interaction in conjunction with game player or other functionality provided by the EGM 100 to the player.

In various example embodiments, a sound chair is associated with the EGM 100 and includes one or more audible sound producing devices (such as speakers) that produce sounds that are coordinated with the tactile feedback provided to the player by the EGM 100 to further enhance the physical player interaction in conjunction with game player or other functionality provided by the EGM 100 to the player.

In further example embodiments of the present disclosure, the EGM includes a player eye or head tracker of the EGM 100 that is configured to track the movement of the eyes or head of the player includes one or more eye tracking or head tracking cameras supported by the housing. The eye tracking or head tracking camera is configured to track the position of the player's eyes or the player's head as they move in front of the display device. More specifically, the eye tracking or head tracking camera is configured to track the position of the player's eyes or the player's head as they move. In the embodiments where two or more eye tracking or head tracking cameras are employed, such multiple cameras work together to track the position of the player's eyes or the player's head as they move in front of the display device. In various embodiments, such multiple cameras are spaced apart, such as spaced apart 6 inches.

In various embodiments, the processor(s), memory device(s), the player eye or head tracker, and the display device of the EGM 100 align the coordinate system of the virtual display area with the real world by using the head position information obtained from the player eye or head tracker. When the player moves his head around, the display device of the EGM causes the displayed virtual object(s) to appear to the player to stay in place where it is. Therefore, the EGM uses the head position to fix the displayed object(s) in space. The actual 2D stereo projection by the display device changes according to the head position, but to the player, the virtual object(s) appears or seems to stay where it is.

It should be appreciated that the location of the eye/head tracking zone may vary in accordance with the present disclosure. It should be appreciated that the eye/head tracking zone may vary in accordance with the present disclosure based on the configuration and position of the eye tracking or head tracking camera. It should also be appreciated that more than one eye tracking or head tracking cameras may be employed in the EGM 100 in accordance with the present disclosure. It should further be appreciated that the one or more eye tracking or head tracking cameras may be employed in the EGM 100 in different positions adjacent to the display device or elsewhere on the EGM 100 in accordance with the present disclosure.

The first display device, the eye tracking or head tracking camera, the one or more processor(s), and the one or more memory device(s) co-act or operate to track the player's eyes or head movements in the eye/head tracking zone in relation to the first display device and the 3D object display area 320 and to adjust the display or projection of each of the virtual object(s) in the 3D object display area 320 based on the player's eye or head movements. In various embodiments, the first display device adjusts the image(s) to be seen by the player's left and right eyes based on the determined position(s) and movement(s) of the player's eyes or head.

In the embodiments with the lenticular lenses, the lenses facilitate the perception of two different images for the left and right eye of the player. In other words, the lenticular lense(s) cause certain pixels of the screen to be visible only to the player's right eye and certain other pixels of the screen to be visible only to the left eye of the player. When the player's head position is changed, the display device also changes the pixel positions for the left eye and the right eye of the player. The head position or changes thereto determined by the eye or head tracker are used by the EGM 100 to choose or select the correct pixels for the left eye and the right eye of the player.

It should also be appreciated that other suitable eye tracking or head tracking systems or devices can be employed in accordance with the present disclosure.

II. EGM—General Components and Operation

The EGM of the present disclosure can be controlled locally by one or more processors, and/or remotely or partially remotely by one or more remote processors, central servers, central controllers, or remote host. In various embodiments, the EGM of the present disclosure can be part of a gaming system (which is also part of the present disclosure) that includes one or more EGMs in combination with one or more remote processors, central servers, central controllers, or remote hosts. In such embodiments, the EGM is configured to communicate with the remote processors, central servers, central controllers, or remote hosts through a data network or remote communication link. In certain such embodiments, the EGM is configured to communicate with one or more other EGMs through the same data network or remote communication link or through a different data network or remote communication link.

In certain embodiments in which the gaming system includes an EGM in combination with a remote processor, central server, central controller, or remote host, the remote processor, central server, central controller, or remote host is any suitable computing device that includes at least one processor and at least one memory device or data storage device. As further described herein, the EGM includes at least one EGM processor configured to transmit and receive data or signals representing events, messages, commands, or any other suitable information between the EGM and the remote processor, central server, central controller, or remote host. The at least one processor of that EGM is configured to execute the events, messages, or commands represented by such data or signals in conjunction with the operation of the EGM. Moreover, the at least one processor of the remote processor, central server, central controller, or remote host is configured to transmit and receive data or signals representing events, messages, commands, or any other suitable information between the remote processor, central server, central controller, or remote host and the EGM. One, more than one, or each of the functions of the at least one processor of the EGM may be performed by the remote processor, the central server, the central controller, or the remote host.

In certain such embodiments, computerized instructions for controlling any games (such as any primary or base games and/or any secondary or bonus games) displayed by the EGM are executed by the remote processor, central server, central controller, or remote host. In such "thin client" embodiments, the remote processor, central server, central controller, or remote host remotely controls any games (or other suitable interfaces) displayed by the EGM, and the EGM is utilized to display such games (or suitable interfaces) and to receive one or more inputs or commands. In other such embodiments, computerized instructions for controlling any games displayed by the EGM are communicated from the remote processor, central server, central controller, or remote host to the EGM and are stored in at least one memory device of the EGM. In such "thick client" embodiments, the at least one processor of the EGM executes the computerized instructions to control any games (or other suitable interfaces) displayed by the EGM.

In various embodiments in which the gaming system includes a plurality of EGMs, one or more of the EGMs are thin client EGMs and one or more of the EGMs are thick client EGMs. In other embodiments in which the gaming system includes one or more EGMs, certain functions of one or more of the EGMs are implemented in a thin client environment, and certain other functions of one or more of the EGMs are implemented in a thick client environment. In one such embodiment in which the gaming system includes an EGM and a remote processor, central server, central controller, or remote host, computerized instructions for controlling any primary or base games displayed by the EGM are communicated from the remote processor, central server, central controller, or remote host to the EGM in a thick client configuration, and computerized instructions for controlling any secondary or bonus games or other functions displayed by the EGM are executed by the remote processor, central server, central controller, or remote host in a thin client configuration.

In certain embodiments in which the gaming system includes: (a) an EGM configured to communicate with a remote processor, central server, central controller, or remote host through a data network; and/or (b) a plurality of EGMs configured to communicate with one another through a data network, the data network is a local area network (LAN) in which the EGMs are located substantially proximate to one another and/or the remote processor, central server, central controller, or remote host. In one example, the EGMs and the remote processor, central server, central controller, or remote host are located in a gaming establishment or a portion of a gaming establishment.

In other embodiments in which the gaming system includes: (a) an EGM configured to communicate with a remote processor, central server, central controller, or remote host through a data network; and/or (b) a plurality of EGMs configured to communicate with one another through a data network, the data network is a wide area network (WAN) in which one or more of the EGMs are not necessarily located substantially proximate to another one of the EGMs and/or the remote processor, central server, central controller, or remote host. For example, one or more of the EGMs are located: (a) in an area of a gaming establishment different from an area of the gaming establishment in which the remote processor, central server, central controller, or remote host is located; or (b) in a gaming establishment different from the gaming establishment in which the remote processor, central server, central controller, or remote host is located. In another example, the remote processor, central server, central controller, or remote host is not located within a gaming establishment in which the EGMs are located. In certain embodiments in which the data network is a WAN, the gaming system includes a remote processor, central server, central controller, or remote host and an EGM each located in a different gaming establishment in a same geographic area, such as a same city or a same state. Gaming systems in which the data network is a WAN are substantially identical to gaming systems in which the data network is a LAN, though the quantity of EGMs in such gaming systems may vary relative to one another.

In further embodiments in which the gaming system includes: (a) an EGM configured to communicate with a remote processor, central server, central controller, or remote host through a data network; and/or (b) a plurality of EGMs configured to communicate with one another through a data network, the data network is an internet (such as the Internet) or an intranet. In certain such embodiments, an Internet browser of the EGM is usable to access an Internet game page from any location where an Internet connection is available. In one such embodiment, after the EGM accesses the Internet game page, the remote processor, central server, central controller, or remote host identifies a player prior to enabling that player to place any wagers on any plays of any wagering games. In one example, the remote processor, central server, central controller, or remote host identifies the player by requiring a player account of the player to be logged into via an input of a unique username and password combination assigned to the player. The remote processor, central server, central controller, or remote host may, however, identify the player in any other suitable manner, such as: by validating a player tracking identification number associated with the player; by reading a player tracking card or other smart card inserted into a card reader (as described below); by validating a unique player identification number associated with the player by the remote processor, central server, central controller, or remote host; or by identifying the EGM, such as by identifying the MAC address or the IP address of the Internet facilitator. In various embodiments, once the remote processor, central server, central controller, or remote host identifies the player, the remote processor, central server, central controller, or remote host enables placement of one or more wagers on one or more plays of one or more primary or base games and/or one or more secondary or bonus games, and displays those plays via the Internet browser of the EGM. Examples of implementations of Internet-based gaming are further described in U.S. Pat. No. 8,764,566, entitled "Internet Remote Game Server," and U.S. Pat. No. 8,147,334, entitled "Universal Game Server".

The remote processor, central server, central controller, or remote host and the EGM are configured to connect to the data network or remote communications link in any suitable manner. In various embodiments, such a connection is accomplished via: a conventional phone line or other data transmission line, a digital subscriber line (DSL), a T-1 line, a coaxial cable, a fiber optic cable, a wireless or wired routing device, a mobile communications network connection (such as a cellular network or mobile Internet network), or any other suitable medium. The expansion in the quantity of computing devices and the quantity and speed of Internet connections in recent years increases opportunities for players to use a variety of EGMs to play games from an ever-increasing quantity of remote sites. Additionally, the enhanced bandwidth of digital wireless communications may render such technology suitable for some or all communications, particularly if such communications are encrypted. Higher data transmission speeds may be useful for enhancing the sophistication and response of the display and interaction with players.

Figure 11:
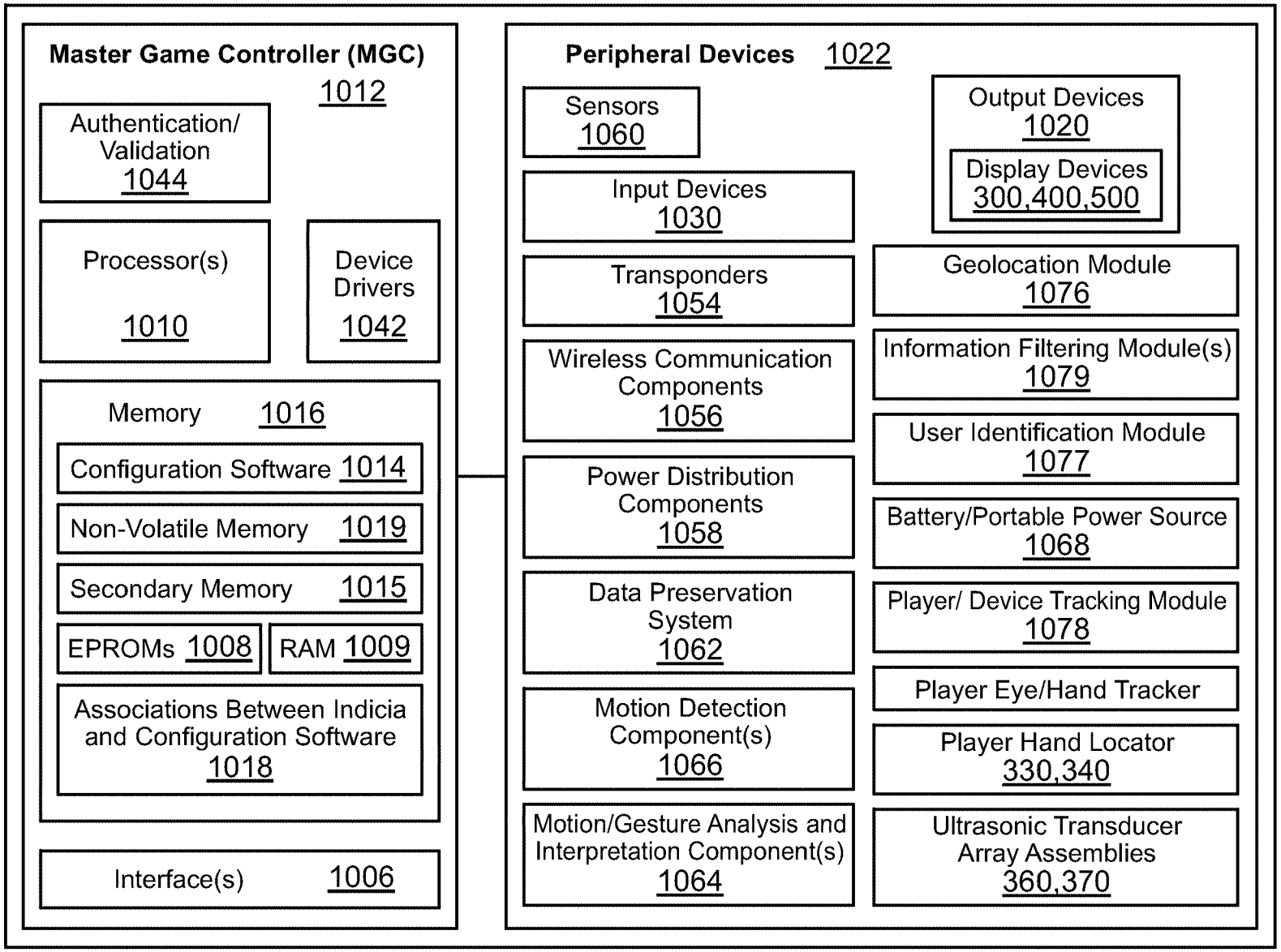
FIG. 11 is a schematic block diagram of one example embodiment of an electronic configuration of the example electronic gaming machine of FIG. 1.

Referring now to FIG. 11, in various embodiments, the EGM 1000 includes a master gaming controller 1012 configured to communicate with and to operate with a plurality of peripheral devices 1022 (in addition to the above described devices 300, 320, 330, 340, 360, 370, 400 and 500).

The master gaming controller 1012 includes at least one processor 1010. The at least one processor 1010 is any suitable processing device or set of processing devices, such as a microprocessor, a microcontroller-based platform, a suitable integrated circuit, or one or more application-specific integrated circuits (ASICs), configured to execute software enabling various configuration and reconfiguration tasks, such as: (1) communicating with a remote source (such as a server that stores authentication information or game information) via a communication interface 1006 of the master gaming controller 1012; (2) converting signals read by an interface to a format corresponding to that used by software or memory of the EGM; (3) accessing memory to configure or reconfigure game parameters in the memory according to indicia read from the EGM; (4) communicating with interfaces and the peripheral devices 1022 (such as input/output devices); and/or (5) controlling the peripheral devices 1022. In certain embodiments, one or more components of the master gaming controller 1012 (such as the at least one processor 1010) reside within a housing of the EGM (described below), while in other embodiments at least one component of the master gaming controller 1012 resides outside of the housing of the EGM.

The master gaming controller 1012 also includes at least one memory device 1016, which includes: (1) volatile memory (e.g., RAM 1009, which can include non-volatile RAM, magnetic RAM, ferroelectric RAM, and any other suitable forms); (2) non-volatile memory 1019 (e.g., disk memory, FLASH memory, EPROMs, EEPROMs, memristor-based non-volatile solid-state memory, etc.); (3) unalterable memory (e.g., EPROMs 1008); (4) read-only memory; and/or (5) a secondary memory storage device 1015, such as a non-volatile memory device, configured to store gaming software related information (the gaming software related information and the memory may be used to store various audio files and games not currently being used and invoked in a configuration or reconfiguration). Any other suitable magnetic, optical, and/or semiconductor memory may operate in conjunction with the EGM disclosed herein. In certain embodiments, the at least one memory device 1016 resides within the housing of the EGM (described below), while in other embodiments at least one component of the at least one memory device 1016 resides outside of the housing of the EGM.

The at least one memory device 1016 is configured to store, for example: (1) configuration software 1014, such as all the parameters and settings for a game playable on the EGM; (2) associations 1018 between configuration indicia read from an EGM with one or more parameters and settings; (3) communication protocols configured to enable the at least one processor 1010 to communicate with the peripheral devices 1022; and/or (4) communication transport protocols (such as TCP/IP, USB, Firewire, IEEE1394, Bluetooth, IEEE 802.11x (IEEE 802.11 standards), hiperlan/2, HomeRF, etc.) configured to enable the EGM to communicate with local and non-local devices using such protocols. In one implementation, the master gaming controller 1012 communicates with other devices using a serial communication protocol. A few non-limiting examples of serial communication protocols that other devices, such as peripherals (e.g., a bill validator or a ticket printer), may use to communicate with the master game controller 1012 include USB, RS-232, and Netplex (a proprietary protocol developed by IGT).

In certain embodiments, the at least one memory device 1016 is configured to store program code and instructions executable by the at least one processor of the EGM to control the EGM. The at least one memory device 1016 of the EGM also stores other operating data, such as image data, event data, input data, random number generators (RNGs) or pseudo-RNGs, paytable data or information, and/or applicable game rules that relate to the play of one or more games on the EGM. In various embodiments, part or all of the program code and/or the operating data described above is stored in at least one detachable or removable memory device including, but not limited to, a cartridge, a disk, a CD ROM, a DVD, a USB memory device, or any other suitable non-transitory computer readable medium. In certain such embodiments, an operator (such as a gaming establishment operator) and/or a player uses such a removable memory device in an EGM to implement at least part of the present disclosure. In other embodiments, part or all of the program code and/or the operating data is downloaded to the at least one memory device of the EGM through any suitable data network described above (such as an Internet or intranet).

The at least one memory device 1016 also stores a plurality of device drivers 1042. Examples of different types of device drivers include device drivers for EGM components and device drivers for the peripheral components 1022. Typically, the device drivers 1042 utilize various communication protocols that enable communication with a particular physical device. The device driver abstracts the hardware implementation of that device. For example, a device driver may be written for each type of card reader that could potentially be connected to the EGM. Non-limiting examples of communication protocols used to implement the device drivers include Netplex, USB, Serial, Ethernet 175, Firewire, I/O debouncer, direct memory map, serial, PCI, parallel, RF, Bluetooth™, near-field communications (e.g., using near-field magnetics), 802.11 (WiFi), etc. In one embodiment, when one type of a particular device is exchanged for another type of the particular device, the at least one processor of the EGM loads the new device driver from the at least one memory device to enable communication with the new device. For instance, one type of card reader in the EGM can be replaced with a second different type of card reader when device drivers for both card readers are stored in the at least one memory device.

In certain embodiments, the software units stored in the at least one memory device 1016 can be upgraded as needed. For instance, when the at least one memory device 1016 is a hard drive, new games, new game options, new parameters, new settings for existing parameters, new settings for new parameters, new device drivers, and new communication protocols can be uploaded to the at least one memory device 1016 from the master game controller 1012 or from some other external device. As another example, when the at least one memory device 1016 includes a CD/DVD drive including a CD/DVD configured to store game options, parameters, and settings, the software stored in the at least one memory device 1016 can be upgraded by replacing a first CD/DVD with a second CD/DVD. In yet another example, when the at least one memory device 1016 uses flash memory 1019 or EPROM 1008 units configured to store games, game options, parameters, and settings, the software stored in the flash and/or EPROM memory units can be upgraded by replacing one or more memory units with new memory units that include the upgraded software. In another embodiment, one or more of the memory devices, such as the hard drive, may be employed in a game software download process from a remote software server.

In some embodiments, the at least one memory device 1016 also stores authentication and/or validation components 1044 configured to authenticate/validate specified EGM components and/or information, such as hardware components, software components, firmware components, peripheral device components, user input device components, information received from one or more user input devices, information stored in the at least one memory device 1016, etc. Examples of various authentication and/or validation components are described in U.S. Pat. No. 6,620,047, entitled "Electronic Gaming Apparatus Having Authentication Data Sets."

In certain embodiments, in addition to the input, output and other components described in the first section above, the peripheral devices 1022 include several device interfaces, such as: (1) at least one output device 1020 including at least one display device 1035; (2) at least one input device 1030 (which may include contact and/or non-contact interfaces); (3) at least one transponder 1054; (4) at least one wireless communication component 1056; (5) at least one wired/wireless power distribution component 1058; (6) at least one sensor 1060; (7) at least one data preservation component 1062; (8) at least one motion/gesture analysis and interpretation component 1064; (9) at least one motion detection component 1066; (10) at least one portable power source 1068; (11) at least one geolocation module 1076; (12) at least one user identification module 1077; (13) at least one player/device tracking module 1078; and (14) at least one information filtering module 1079.

The at least one output device 1020 includes at least one display device 1035 configured to display any game(s) displayed by the EGM and any suitable information associated with such game(s). In certain embodiments, the display devices are connected to or mounted on a housing of the EGM (described below). In various embodiments, the display devices serve as digital glass configured to advertise certain games or other aspects of the gaming establishment in which the EGM is located. In various embodiments, the EGM includes one or more of the following display devices: (a) a central display device; (b) a player tracking display configured to display various information regarding a player's player tracking status (as described below); (c) a secondary or upper display device in addition to the central display device and the player tracking display; (d) a credit display configured to display a current quantity of credits, amount of cash, account balance, or the equivalent; and (e) a bet display configured to display an amount wagered for one or more plays of one or more games. The example EGM 100 illustrated in FIG. 1 includes a first display device 300, a player tracking display, a credit display, and a bet display.

In various embodiments, the display devices include, without limitation: a monitor, a television display, a plasma display, a liquid crystal display (LCD), a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In certain embodiments, as described above, the display device includes a touch-screen with an associated touch-screen controller. The display devices may be of any suitable sizes, shapes, and configurations.

The display devices of the EGM are configured to display one or more game and/or non-game images, symbols, and indicia. In certain embodiments, the display devices of the EGM are configured to display any suitable visual representation or exhibition of the movement of objects; dynamic lighting; video images; images of people, characters, places, things, and faces of cards; and the like. In certain embodiments, the display devices of the EGM are configured to display one or more video reels, one or more video wheels, and/or one or more video dice. In other embodiments, certain of the displayed images, symbols, and indicia are in mechanical form. That is, in these embodiments, the display device includes any electromechanical device, such as one or more rotatable wheels, one or more reels, and/or one or more dice, configured to display at least one or a plurality of game or other suitable images, symbols, or indicia.

In various embodiments, the at least one output device 1020 includes a payout device. In these embodiments, after the EGM receives an actuation of a cashout device (described below), the EGM causes the payout device to provide a payment to the player. In one embodiment, the payout device is one or more of: (a) a ticket printer and dispenser configured to print and dispense a ticket or credit slip associated with a monetary value, wherein the ticket or credit slip may be redeemed for its monetary value via a cashier, a kiosk, or other suitable redemption system; (b) a bill dispenser configured to dispense paper currency; (c) a coin dispenser configured to dispense coins or tokens (such as into a coin payout tray); and (d) any suitable combination thereof. The example EGM 100 and illustrated in FIG. 1 may include a ticket printer and dispenser. Examples of ticket-in ticket-out (TITO) technology are described in U.S. Pat. No. 5,429,361, entitled "Gaming Machine Information, Communication and Display System"; U.S. Pat. No. 5,470,079, entitled "Gaming Machine Accounting and Monitoring System"; U.S. Pat. No. 5,265,874, entitled "Cashless Gaming Apparatus and Method"; U.S. Pat. No. 6,729,957, entitled "Gaming Method and Host Computer with Ticket-In/Ticket-Out Capability"; U.S. Pat. No. 6,729,958, entitled "Gaming System with Ticket-In/Ticket-Out Capability"; U.S. Pat. No. 6,736,725, entitled "Gaming Method and Host Computer with Ticket-In/Ticket-Out Capability"; U.S. Pat. No. 7,275,991, entitled "Slot Machine with Ticket-In/Ticket-Out Capability"; U.S. Pat. No. 6,048,269, entitled "Coinless Slot Machine System and Method".

In certain embodiments, rather than dispensing bills, coins, or a physical ticket having a monetary value to the player following receipt of an actuation of the cashout device, the payout device is configured to cause a payment to be provided to the player in the form of an electronic funds transfer, such as via a direct deposit into a bank account, a casino account, or a prepaid account of the player; via a transfer of funds onto an electronically recordable identification card or smart card of the player; or via sending a virtual ticket having a monetary value to an electronic device of the player. Examples of providing payment using virtual tickets are described in U.S. Pat. No. 8,613,659, entitled "Virtual Ticket-In and Ticket-Out on a Gaming Machine," which is incorporated herein by reference.

While any credit balances, any wagers, any values, and any awards are described herein as amounts of monetary credits or currency, one or more of such credit balances, such wagers, such values, and such awards may be for non-monetary credits, promotional credits, of player tracking points or credits.

In certain embodiments, the at least one output device 1020 includes one or more sound generating devices controlled by one or more sound cards. In one such embodiment, the sound generating device includes one or more speakers or other sound generating hardware and/or software configured to generate sounds, such as by playing music for any games or by playing music for other modes of the EGM, such as an attract mode. The example EGM 100 illustrated in FIG. 1 includes a plurality of speakers. In another such embodiment, the EGM provides dynamic sounds coupled with attractive multimedia images displayed on one or more of the display devices to provide an audio-visual representation or to otherwise display full-motion video with sound to attract players to the EGM. In certain embodiments, the EGM displays a sequence of audio and/or visual attraction messages during idle periods to attract potential players to the EGM. The videos may be customized to provide any appropriate information.

The at least one input device 1030 may include any suitable device that enables an input signal to be produced and received by the at least one processor 1010 of the EGM.

In one embodiment, the at least one input device 1030 includes a payment device configured to communicate with the at least one processor of the EGM to fund the EGM. In certain embodiments, the payment device includes one or more of: (a) a bill acceptor into which paper money is inserted to fund the EGM; (b) a ticket acceptor into which a ticket or a voucher is inserted to fund the EGM; (c) a coin slot into which coins or tokens are inserted to fund the EGM; (d) a reader or a validator for credit cards, debit cards, or credit slips into which a credit card, debit card, or credit slip is inserted to fund the EGM; (e) a player identification card reader into which a player identification card is inserted to fund the EGM; or (f) any suitable combination thereof. The example EGM 100 illustrated in FIG. 1 may include a combined bill and ticket acceptor and a coin slot.

In one embodiment, the at least one input device 1030 includes a payment device configured to enable the EGM to be funded via an electronic funds transfer, such as a transfer of funds from a bank account. In another embodiment, the EGM includes a payment device configured to communicate with a mobile device of a player, such as a mobile phone, a radio frequency identification tag, or any other suitable wired or wireless device, to retrieve relevant information associated with that player to fund the EGM. Examples of funding an EGM via communication between the EGM and a mobile device (such as a mobile phone) of a player are described in U.S. Patent Application Publication No. 2013/0344942, entitled "Avatar as Security Measure for Mobile Device Use with Electronic Gaming Machine." When the EGM is funded, the at least one processor determines the amount of funds entered and displays the corresponding amount on a credit display or any other suitable display as described below.

In certain embodiments, the at least one input device 1030 includes at least one wagering or betting device. In various embodiments, the one or more wagering or betting devices are each: (1) a mechanical button supported by the housing of the EGM (such as a hard key or a programmable soft key), or (2) an icon displayed on a display device of the EGM (described below) that is actuatable via a touch screen of the EGM (described below) or via use of a suitable input device of the EGM (such as a mouse or a joystick). One such wagering or betting device is as a maximum wager or bet device that, when actuated, causes the EGM to place a maximum wager on a play of a game. Another such wagering or betting device is a repeat bet device that, when actuated, causes the EGM to place a wager that is equal to the previously-placed wager on a play of a game. A further such wagering or betting device is a bet one device that, when actuated, causes the EGM to increase the wager by one credit. Generally, upon actuation of one of the wagering or betting devices, the quantity of credits displayed in a credit meter (described below) decreases by the amount of credits wagered, while the quantity of credits displayed in a bet display (described below) increases by the amount of credits wagered.

In various embodiments, the at least one input device 1030 includes at least one game play activation device. In various embodiments, the one or more game play initiation devices are each: (1) a mechanical button supported by the housing of the EGM (such as a hard key or a programmable soft key), or (2) an icon displayed on a display device of the EGM (described below) that is actuatable via a touch screen of the EGM (described below) or via use of a suitable input device of the EGM (such as a mouse or a joystick). After a player appropriately funds the EGM and places a wager, the EGM activates the game play activation device to enable the player to actuate the game play activation device to initiate a play of a game on the EGM (or another suitable sequence of events associated with the EGM). After the EGM receives an actuation of the game play activation device, the EGM initiates the play of the game. The example EGM 100 illustrated in FIG. 1 may include a game play activation device in the form of a game play initiation button. In other embodiments, the EGM begins game play automatically upon appropriate funding rather than upon utilization of the game play activation device.

In other embodiments, the at least one input device 1030 includes a cashout device. In various embodiments, the cashout device is: (1) a mechanical button supported by the housing of the EGM (such as a hard key or a programmable soft key), or (2) an icon displayed on a display device of the EGM (described below) that is actuatable via a touch screen of the EGM (described below) or via use of a suitable input device of the EGM (such as a mouse or a joystick). When the EGM receives an actuation of the cashout device from a player and the player has a positive (i.e., greater-than-zero) credit balance, the EGM initiates a payout associated with the player's credit balance. The example EGM 100 illustrated in FIG. 1 may include a cashout device in the form of a cashout button.

In various embodiments, the at least one input device includes a plurality of buttons that are programmable by the EGM operator to, when actuated, cause the EGM to perform particular functions. For instance, such buttons may be hard keys, programmable soft keys, or icons displayed on a display device of the EGM (described below) that are actuatable via a touch screen of the EGM (described below) or via use of a suitable input device of the EGM (such as a mouse or a joystick). The example EGM 100 illustrated in FIG. 1 may include a plurality of such buttons.

In certain embodiments, the at least one input device 1030 includes a touch-screen coupled to a touch-screen controller or other touch-sensitive display overlay to enable interaction with any images displayed on a display device (as described below). One such input device is a conventional touch-screen button panel. The touch-screen and the touch-screen controller are connected to a video controller. In these embodiments, signals are input to the EGM by touching the touch screen at the appropriate locations.

In embodiments including a player tracking system, as further described below, the at least one input device 1030 includes a card reader in communication with the at least one processor of the EGM. The example EGM 100 illustrated in FIG. 1 may include a card reader. The card reader is configured to read a player identification card inserted into the card reader.

The at least one wireless communication component 1056 includes one or more communication interfaces having different architectures and utilizing a variety of protocols, such as (but not limited to) 802.11 (WiFi); 802.15 (including Bluetooth™); 802.16 (WiMax); 802.22; cellular standards such as CDMA, CDMA2000, and WCDMA; Radio Frequency (e.g., RFID); infrared; and Near Field Magnetic communication protocols. The at least one wireless communication component 1056 transmits electrical, electromagnetic, or optical signals that carry digital data streams or analog signals representing various types of information.

The at least one wired/wireless power distribution component 1058 includes components or devices that are configured to provide power to other devices. For example, in one embodiment, the at least one power distribution component 1058 includes a magnetic induction system that is configured to provide wireless power to one or more user input devices near the EGM. In one embodiment, a user input device docking region is provided, and includes a power distribution component that is configured to recharge a user input device without requiring metal-to-metal contact. In one embodiment, the at least one power distribution component 1058 is configured to distribute power to one or more internal components of the EGM, such as one or more rechargeable power sources (e.g., rechargeable batteries) located at the EGM.

In certain embodiments, in addition to the components described in the first section above, the at least one sensor 1060 includes at least one of: optical sensors, pressure sensors, RF sensors, infrared sensors, image sensors, thermal sensors, and biometric sensors. The at least one sensor 1060 may be used for a variety of functions, such as: detecting movements and/or gestures of various objects within a predetermined proximity to the EGM (in addition to the detections described above); detecting the presence and/or identity of various persons (e.g., players, casino employees, etc.), devices (e.g., user input devices), and/or systems within a predetermined proximity to the EGM.

The at least one data preservation component 1062 is configured to detect or sense one or more events and/or conditions that, for example, may result in damage to the EGM and/or that may result in loss of information associated with the EGM. Additionally, the data preservation system 1062 may be operable to initiate one or more appropriate action(s) in response to the detection of such events/conditions.

In addition to the eye or head tracker described above, the EGM of the present disclosure can also include at least one motion/gesture analysis and interpretation component 1064 configured to analyze and/or interpret information relating to detected player movements and/or gestures to determine appropriate player input information relating to the detected player movements and/or gestures. For example, in one embodiment, the at least one motion/gesture analysis and interpretation component 1064 is configured to perform one or more of the following functions: analyze the detected gross motion or gestures of a player; interpret the player's motion or gestures (e.g., in the context of a casino game being played) to identify instructions or input from the player; utilize the interpreted instructions/input to advance the game state; etc. In other embodiments, at least a portion of these additional functions may be implemented at a remote system or device.

The at least one portable power source 1068 enables the EGM 1000 to operate in a mobile environment. For example, in one embodiment, the EGM 100 includes one or more rechargeable batteries.

The at least one geolocation module 1076 is configured to acquire geolocation information from one or more remote sources and use the acquired geolocation information to determine information relating to a relative and/or absolute position of the EGM. For example, in one implementation, the at least one geolocation module 1076 is configured to receive GPS signal information for use in determining the position or location of the EGM. In another implementation, the at least one geolocation module 1076 is configured to receive multiple wireless signals from multiple remote devices (e.g., EGMs, servers, wireless access points, etc.) and use the signal information to compute position/location information relating to the position or location of the EGM.

The at least one user identification module 1077 is configured to determine the identity of the current user or current owner of the EGM. For example, in one embodiment, the current user is required to perform a login process at the EGM in order to access one or more features. Alternatively, the EGM is configured to automatically determine the identity of the current user based on one or more external signals, such as an RFID tag or badge worn by the current user and that provides a wireless signal to the EGM that is used to determine the identity of the current user. In at least one embodiment, various security features are incorporated into the EGM to prevent unauthorized users from accessing confidential or sensitive information.

The at least one information filtering module 1079 is configured to perform filtering (e.g., based on specified criteria) of selected information to be displayed at one or more displays 1035 of the EGM.

In various embodiments, the EGM includes a plurality of communication ports configured to enable the at least one processor of the EGM to communicate with and to operate with external peripherals, such as: accelerometers, arcade sticks, bar code readers, bill validators, biometric input devices, bonus devices, button panels, card readers, coin dispensers, coin hoppers, display screens or other displays or video sources, expansion buses, information panels, keypads, lights, mass storage devices, microphones, motion sensors, motors, printers, reels, SCSI ports, solenoids, speakers, thumbsticks, ticket readers, touch screens, trackballs, touchpads, wheels, and wireless communication devices. U.S. Pat. No. 7,290,072 describes a variety of EGMs including one or more communication ports that enable the EGMs to communicate and operate with one or more external peripherals.

In certain embodiments, the EGM is a device that has obtained approval from a regulatory gaming commission, and in other embodiments, the EGM is a device that has not obtained approval from a regulatory gaming commission.

The EGMs described above are merely examples of different types of EGMs. Certain of these example EGMs may include one or more elements that may not be included in all gaming systems, and these example EGMs may not include one or more elements that are included in other gaming systems. For example, certain EGMs include a coin acceptor while others do not.

In various embodiments, an EGM may be implemented in one of a variety of different configurations. In various embodiments, the EGM may be implemented as one of: (a) a dedicated EGM in which computerized game programs executable by the EGM for controlling any primary or base games (sometimes referred to herein as "primary games") and/or any secondary or bonus games or other functions (sometimes referred to herein as "secondary games") displayed by the EGM are provided with the EGM prior to delivery to a gaming establishment or prior to being provided to a player; and (b) a changeable EGM in which computerized game programs executable by the EGM for controlling any primary games and/or secondary games displayed by the EGM are downloadable or otherwise transferred to the EGM through a data network or remote communication link; from a USB drive, flash memory card, or other suitable memory device; or in any other suitable manner after the EGM is physically located in a gaming establishment or after the EGM is provided to a player.

As generally explained above, in various embodiments in which the gaming system includes a remote processor, central server, central controller, or remote host and a changeable EGM, the at least one memory device of the remote processor, central server, central controller, or remote host stores different game programs and instructions executable by the at least one processor of the changeable EGM to control one or more primary games and/or secondary games displayed by the changeable EGM. More specifically, each such executable game program represents a different game or a different type of game that the at least one changeable EGM is configured to operate. In one example, certain of the game programs are executable by the changeable EGM to operate games having the same or substantially the same game play but different paytables. In different embodiments, each executable game program is associated with a primary game, a secondary game, or both. In certain embodiments, an executable game program is executable by the at least one processor of the at least one changeable EGM as a secondary game to be played simultaneously with a play of a primary game (which may be downloaded to or otherwise stored on the at least one changeable EGM), or vice versa.

In operation of such embodiments, the remote processor, central server, central controller, or remote host is configured to communicate one or more of the stored executable game programs to the at least one processor of the changeable EGM. In different embodiments, a stored executable game program is communicated or delivered to the at least one processor of the changeable EGM by: (a) embedding the executable game program in a device or a component (such as a microchip to be inserted into the changeable EGM); (b) writing the executable game program onto a disc or other media; or (c) uploading or streaming the executable game program over a data network (such as a dedicated data network). After the executable game program is communicated from the central server, central controller, or remote host to the changeable EGM, the at least one processor of the changeable EGM executes the executable game program to enable the primary game and/or the secondary game associated with that executable game program to be played using the display device(s) and/or the input device(s) of the changeable EGM. That is, when an executable game program is communicated to the at least one processor of the changeable EGM, the at least one processor of the changeable EGM changes the game or the type of game that may be played using the changeable EGM.

In certain embodiments, the EGM randomly determines any game outcome(s) (such as a win outcome) and/or award(s) (such as a quantity of credits to award for the win outcome) for a play of a primary game and/or a play of a secondary game based on probability data. In certain such embodiments, this random determination is provided through utilization of an RNG, such as a true RNG or a pseudo RNG, or any other suitable randomization process. In one such embodiment, each game outcome or award is associated with a probability, and the EGM generates the game outcome(s) and/or the award(s) to be provided based on the associated probabilities. In these embodiments, since the EGM generates game outcomes and/or awards randomly or based on one or more probability calculations, there is no certainty that the EGM will ever provide any specific game outcome and/or award.

In certain embodiments, the EGM maintains one or more predetermined pools or sets of predetermined game outcomes and/or awards. In certain such embodiments, upon generation or receipt of a game outcome and/or award request, the EGM independently selects one of the predetermined game outcomes and/or awards from the one or more pools or sets. The EGM flags or marks the selected game outcome and/or award as used. Once a game outcome or an award is flagged as used, it is prevented from further selection from its respective pool or set; that is, the EGM does not select that game outcome or award upon another game outcome and/or award request. The EGM provides the selected game outcome and/or award. Examples of this type of award evaluation are described in U.S. Pat. No. 7,470, 183, entitled "Finite Pool Gaming Method and Apparatus"; U.S. Pat. No. 7,563,163, entitled "Gaming Device Including Outcome Pools for Providing Game Outcomes"; U.S. Pat. No. 7,833,092, entitled "Method and System for Compensating for Player Choice in a Game of Chance"; U.S. Pat. No. 8,070,579, entitled "Bingo System with Downloadable Common Patterns"; and U.S. Pat. No. 8,398,472, entitled "Central Determination Poker Game."

In certain embodiments, the EGM determines a predetermined game outcome and/or award based on the results of a bingo, keno, or lottery game. In certain such embodiments, the EGM utilizes one or more bingo, keno, or lottery games to determine the predetermined game outcome and/or award provided for a primary game and/or a secondary game. The EGM is provided or associated with a bingo card. Each bingo card consists of a matrix or array of elements, wherein each element is designated with separate indicia. After a bingo card is provided, the EGM randomly selects or draws a plurality of the elements. As each element is selected, a determination is made as to whether the selected element is present on the bingo card. If the selected element is present on the bingo card, that selected element on the provided bingo card is marked or flagged. This process of selecting elements and marking any selected elements on the provided bingo cards continues until one or more predetermined patterns are marked on one or more of the provided bingo cards. After one or more predetermined patterns are marked on one or more of the provided bingo cards, game outcome and/or award is determined based, at least in part, on the selected elements on the provided bingo cards. Examples of this type of award determination are described in U.S. Pat. No. 7,753,774, entitled "Using Multiple Bingo Cards to Represent Multiple Slot Paylines and Other Class III Game Options"; U.S. Pat. No. 7,731,581, entitled "Multi-Player Bingo Game with Multiple Alternative Outcome Displays"; U.S. Pat. No. 7,955,170, entitled "Providing Non-Bingo Outcomes for a Bingo Game"; U.S. Pat. No. 8,070,579, entitled "Bingo System with Downloadable Common Patterns"; and U.S. Pat. No. 8,500,538, entitled "Bingo Gaming System and Method for Providing Multiple Outcomes from Single Bingo Pattern."

In certain embodiments in which the EGM is configured to communicate with the remote processor, central server, central controller, or remote host for monitoring purposes only. In such embodiments, the EGM determines the game outcome(s) and/or award(s) to be provided in any of the manners described above, and the remote processor, central server, central controller, or remote host monitors the activities and events occurring on the EGM. In one such embodiment, the EGM includes a real-time or online accounting and gaming information system configured to communicate with the central server, central controller, or remote host. In this embodiment, the accounting and gaming information system includes: (a) a player database configured to store player profiles, (b) a player tracking module configured to track players (as described below), and (c) a credit system configured to provide automated transactions. Examples of such accounting systems are described in U.S. Pat. No. 6,913,534, entitled "Gaming Machine Having a Lottery Game and Capability for Integration with Gaming Device Accounting System and Player Tracking System," and U.S. Pat. No. 8,597,116, entitled "Virtual Player Tracking and Related Services."

As noted above, in various embodiments, the EGM includes one or more executable game programs executable by at least one processor of the EGM to provide one or more primary games and one or more secondary games. The primary game(s) and the secondary game(s) may comprise any suitable games and/or wagering games, such as, but not limited to: electro-mechanical or video slot or spinning reel type games; video card games such as video draw poker, multi-hand video draw poker, other video poker games, video blackjack games, and video baccarat games; video keno games; video bingo games; and video selection games.

In certain embodiments in which the primary game is a slot or spinning reel type game, the EGM includes one or more reels in either an electromechanical form with mechanical rotating reels or in a video form with simulated reels and movement thereof. Each reel displays a plurality of indicia or symbols, such as bells, hearts, fruits, numbers, letters, bars, or other images that typically correspond to a theme associated with the EGM. In certain such embodiments, the EGM includes one or more paylines associated with the reels. In certain embodiments, one or more of the reels are independent reels or unisymbol reels. In such embodiments, each independent reel generates and displays one symbol.

In various embodiments, one or more of the paylines is horizontal, vertical, circular, diagonal, angled, or any suitable combination thereof. In other embodiments, each of one or more of the paylines is associated with a plurality of adjacent symbol display areas on a requisite number of adjacent reels. In one such embodiment, one or more paylines are formed between at least two symbol display areas that are adjacent to each other by either sharing a common side or sharing a common corner (i.e., such paylines are connected paylines). The EGM enables a wager to be placed on one or more of such paylines to activate such paylines. In other embodiments in which one or more paylines are formed between at least two adjacent symbol display areas, the EGM enables a wager to be placed on a plurality of symbol display areas, which activates those symbol display areas.

In various embodiments, the EGM provides one or more awards after a spin of the reels when specified types and/or configurations of the indicia or symbols on the reels occur on an active payline or otherwise occur in a winning pattern, occur on the requisite number of adjacent reels, and/or occur in a scatter pay arrangement.

In certain embodiments, the EGM employs a ways to win award determination. In these embodiments, any outcome to be provided is determined based on a number of associated symbols that are generated in active symbol display areas on the requisite number of adjacent reels (i.e., not on paylines passing through any displayed winning symbol combinations). If a winning symbol combination is generated on the reels, one award for that occurrence of the generated winning symbol combination is provided. Examples of ways to win award determinations are described in U.S. Pat. No. 8,012,011, entitled "Gaming Device and Method Having Independent Reels and Multiple Ways of Winning"; U.S. Pat. No. 8,241,104, entitled "Gaming Device and Method Having Designated Rules for Determining Ways To Win"; and U.S. Pat. No. 8,430,739, entitled "Gaming System and Method Having Wager Dependent Different Symbol Evaluations."

In various embodiments, the EGM includes a progressive award. Typically, a progressive award includes an initial amount and an additional amount funded through a portion of each wager placed to initiate a play of a primary game. When one or more triggering events occurs, the EGM provides at least a portion of the progressive award. After the EGM provides the progressive award, an amount of the progressive award is reset to the initial amount and a portion of each subsequent wager is allocated to the next progressive award. Examples of progressive gaming systems or EGMs are described in U.S. Pat. No. 7,585,223, entitled "Server Based Gaming System Having Multiple Progressive Awards"; U.S. Pat. No. 7,651,392, entitled "Gaming Device System Having Partial Progressive Payout"; U.S. Pat. No. 7,666,093, entitled "Gaming Method and Device Involving Progressive Wagers"; U.S. Pat. No. 7,780,523, entitled "Server Based Gaming System Having Multiple Progressive Awards"; and U.S. Pat. No. 8,337,298, entitled "Gaming Device Having Multiple Different Types of Progressive Awards."

As generally noted above, in addition to providing winning credits or other awards for one or more plays of the primary game(s), in various embodiments the EGM provides credits or other awards for one or more plays of one or more secondary games. The secondary game typically enables an award to be obtained addition to any award obtained through play of the primary game(s). The secondary game(s) typically produces a higher level of player excitement than the primary game(s) because the secondary game(s) provides a greater expectation of winning than the primary game(s) and is accompanied with more attractive or unusual features than the primary game(s). The secondary game(s) may be any type of suitable game, either similar to or completely different from the primary game.

In various embodiments, the EGM automatically provides or initiates the secondary game upon the occurrence of a triggering event or the satisfaction of a qualifying condition. In other embodiments, the EGM initiates the secondary game upon the occurrence of the triggering event or the satisfaction of the qualifying condition and upon receipt of an initiation input. In certain embodiments, the triggering event or qualifying condition is a selected outcome in the primary game(s) or a particular arrangement of one or more indicia on a display device for a play of the primary game(s), such as a "BONUS" symbol appearing on three adjacent reels along a payline following a spin of the reels for a play of the primary game. In other embodiments, the triggering event or qualifying condition occurs based on a certain amount of game play (such as number of games, number of credits, amount of time) being exceeded, or based on a specified number of points being earned during game play. Any suitable triggering event or qualifying condition or any suitable combination of a plurality of different triggering events or qualifying conditions may be employed.

In other embodiments, at least one processor of the EGM randomly determines when to provide one or more plays of one or more secondary games. In one such embodiment, no apparent reason is provided for providing the secondary game. In this embodiment, qualifying for a secondary game is not triggered by the occurrence of an event in any primary game or based specifically on any of the plays of any primary game. That is, qualification is provided without any explanation or, alternatively, with a simple explanation. In another such embodiment, the EGM determines qualification for a secondary game at least partially based on a game triggered or symbol triggered event, such as at least partially based on play of a primary game.

In various embodiments, after qualification for a secondary game has been determined, the secondary game participation may be enhanced through continued play on the primary game. Thus, in certain embodiments, for each secondary game qualifying event, such as a secondary game symbol, that is obtained, a given number of secondary game wagering points or credits is accumulated in a "secondary game meter" configured to accrue the secondary game wagering credits or entries toward eventual participation in the secondary game. In one such embodiment, the occurrence of multiple such secondary game qualifying events in the primary game results in an arithmetic or exponential increase in the number of secondary game wagering credits awarded. In another such embodiment, any extra secondary game wagering credits may be redeemed during the secondary game to extend play of the secondary game.

In certain embodiments, no separate entry fee or buy-in for the secondary game is required. That is, entry into the secondary game cannot be purchased; rather, in these embodiments entry must be won or earned through play of the primary game, thereby encouraging play of the primary game. In other embodiments, qualification for the secondary game is accomplished through a simple "buy-in." For example, qualification through other specified activities is unsuccessful, payment of a fee or placement of an additional wager "buys-in" to the secondary game. In certain embodiments, a separate side wager must be placed on the secondary game or a wager of a designated amount must be placed on the primary game to enable qualification for the secondary game. In these embodiments, the secondary game triggering event must occur and the side wager (or designated primary game wager amount) must have been placed for the secondary game to trigger.

In various embodiments in which the gaming system includes a plurality of EGMs, the EGMs are configured to communicate with one another to provide a group gaming environment. In certain such embodiments, the EGMs enable players of those EGMs to work in conjunction with one another, such as by enabling the players to play together as a team or group, to win one or more awards. In other such embodiments, the EGMs enable players of those EGMs to compete against one another for one or more awards. In one such embodiment, the EGMs enable the players of those EGMs to participate in one or more gaming tournaments for one or more awards. Examples of group gaming systems are described in U.S. Pat. No. 8,070,583, entitled "Server Based Gaming System and Method for Selectively Providing One or More Different Tournaments"; U.S. Pat. No. 8,500,548, entitled "Gaming System and Method for Providing Team Progressive Awards"; and U.S. Pat. No. 8,562,423, entitled "Method and Apparatus for Rewarding Multiple Game Players for a Single Win."

In various embodiments, the gaming system or EGM includes one or more player tracking systems. Such player tracking systems enable operators of the gaming system or EGM (such as casinos or other gaming establishments) to recognize the value of customer loyalty by identifying frequent customers and rewarding them for their patronage. Such a player tracking system is configured to track a player's gaming activity. In one such embodiment, the player tracking system does so through the use of player tracking cards. In this embodiment, a player is issued a player identification card that has an encoded player identification number that uniquely identifies the player. When the player's playing tracking card is inserted into a card reader of the EGM to begin a gaming session, the card reader reads the player identification number off the player tracking card to identify the player. The EGM timely tracks any suitable information or data relating to the identified player's gaming session. The EGM also timely tracks when the player tracking card is removed to conclude play for that gaming session. In another embodiment, rather than requiring insertion of a player tracking card into the card reader, the EGM utilizes one or more portable devices, such as a mobile phone, a radio frequency identification tag, or any other suitable wireless device, to track when a gaming session begins and ends. In another embodiment, the EGM utilizes any suitable biometric technology or ticket technology to track when a gaming session begins and ends.

In such embodiments, during one or more gaming sessions, the EGM tracks any suitable information or data, such as any amounts wagered, average wager amounts, and/or the time at which these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In various embodiments, such tracked information and/or any suitable feature associated with the player tracking system is displayed on a player tracking display. In various embodiments, such tracked information and/or any suitable feature associated with the player tracking system is displayed via one or more service windows that are displayed on the first display device and/or the upper display device. Examples of player tracking systems are described in U.S. Pat. No. 6,722,985, entitled "Universal Player Tracking System"; U.S. Pat. No. 6,908,387, entitled "Player Tracking Communication Mechanisms in a Gaming Machine"; U.S. Pat. No. 7,311,605, entitled "Player Tracking Assembly for Complete Patron Tracking for Both Gaming and Non-Gaming Casino Activity"; U.S. Pat. No. 7,611,411, entitled "Player Tracking Instruments Having Multiple Communication Modes"; U.S. Pat. No. 7,617,151, entitled "Alternative Player Tracking Techniques"; and U.S. Pat. No. 8,057,298, entitled "Virtual Player Tracking and Related Services."

Certain of the gaming systems described herein, including EGMs located in a casino or another gaming establishment, include certain components and/or are configured to operate in certain manners that differentiate these EGMs and systems from general purpose computing devices (i.e., certain personal gaming devices such as desktop computers and laptop computers).

For instance, EGMs are highly regulated to ensure fairness and, in many cases, EGMs are configured to award monetary awards up to multiple millions of dollars. To satisfy security and regulatory requirements in a gaming environment, hardware and/or software architectures are implemented in EGMs that differ significantly from those of general purpose computing devices. For purposes of illustration, a description of EGMs relative to general purpose computing devices and some examples of these additional (or different) hardware and/or software architectures found in EGMs are described below.

At first glance, one might think that adapting general purpose computing device technologies to the gaming industry and EGMs would be a simple proposition because both general purpose computing devices and EGMs employ processors that control a variety of devices. However, due to at least: (1) the regulatory requirements placed on EGMs, (2) the harsh environment in which EGMs operate, (3) security requirements, and (4) fault tolerance requirements, adapting general purpose computing device technologies to EGMs can be quite difficult. Further, techniques and methods for solving a problem in the general purpose computing device industry, such as device compatibility and connectivity issues, might not be adequate in the gaming industry. For instance, a fault or a weakness tolerated in a general purpose computing device, such as security holes in software or frequent crashes, is not tolerated in an EGM because in an EGM these faults can lead to a direct loss of funds from the EGM, such as stolen cash or loss of revenue when the EGM is not operating properly or when the random outcome determination is manipulated.

Certain differences between general purpose computing devices and EGMs are described below. A first difference between EGMs and general purpose computing devices is that EGMs are state-based systems. A state-based system stores and maintains its current state in a non-volatile memory such that, in the event of a power failure or other malfunction, the state-based system can return to that state when the power is restored or the malfunction is remedied. For instance, for a state-based EGM, if the EGM displays an award for a game of chance but the power to the EGM fails before the EGM provides the award to the player, the EGM stores the pre-power failure state in a non-volatile memory, returns to that state upon restoration of power, and provides the award to the player. This requirement affects the software and hardware design on EGMs. General purpose computing devices are typically not state-based machines, and a majority of data can be lost when a malfunction occurs on a general purpose computing device.

A second difference between EGMs and general purpose computing devices is that, for regulatory purposes, the software on the EGM utilized to operate the EGM has been designed to be static and monolithic to prevent cheating by the operator of the EGM. For instance, one solution that has been employed in the gaming industry to prevent cheating and to satisfy regulatory requirements has been to manufacture an EGM that can use a proprietary processor running instructions to provide the game of chance from an EPROM or other form of non-volatile memory. The coding instructions on the EPROM are static (non-changeable) and must be approved by a gaming regulators in a particular jurisdiction and installed in the presence of a person representing the gaming jurisdiction. Any changes to any part of the software required to generate the game of chance, such as adding a new device driver used to operate a device during generation of the game of chance, can require burning a new EPROM approved by the gaming jurisdiction and reinstalling the new EPROM on the EGM in the presence of a gaming regulator. Regardless of whether the EPROM solution is used, to gain approval in most gaming jurisdictions, an EGM must demonstrate sufficient safeguards that prevent an operator or a player of an EGM from manipulating the EGM's hardware and software in a manner that gives him an unfair, and in some cases illegal, advantage.

A third difference between EGMs and general purpose computing devices is authentication—EGMs storing code are configured to authenticate the code to determine if the code is unaltered before executing the code. If the code has been altered, the EGM prevents the code from being executed. The code authentication requirements in the gaming industry affect both hardware and software designs on EGMs. Certain EGMs use hash functions to authenticate code. For instance, one EGM stores game program code, a hash function, and an authentication hash (which may be encrypted). Before executing the game program code, the EGM hashes the game program code using the hash function to obtain a result hash and compares the result hash to the authentication hash. If the result hash matches the authentication hash, the EGM determines that the game program code is valid and executes the game program code. If the result hash does not match the authentication hash, the EGM determines that the game program code has been altered (i.e., may have been tampered with) and prevents execution of the game program code. Examples of EGM code authentication are described in U.S. Pat. No. 6,962,530, entitled "Authentication in a Secure Computerized Gaming System"; U.S. Pat. No. 7,043,641, entitled "Encryption in a Secure Computerized Gaming System"; U.S. Pat. No. 7,201,662, entitled "Method and Apparatus for Software Authentication"; and U.S. Pat. No. 8,627,097, entitled "System and Method Enabling Parallel Processing of Hash Functions Using Authentication Checkpoint Hashes."

A fourth difference between EGMs and general purpose computing devices is that EGMs have unique peripheral device requirements that differ from those of a general purpose computing device, such as peripheral device security requirements not usually addressed by general purpose computing devices. For instance, monetary devices, such as coin dispensers, bill validators, and ticket printers and computing devices that are used to govern the input and output of cash or other items having monetary value (such as tickets) to and from an EGM have security requirements that are not typically addressed in general purpose computing devices. Therefore, many general purpose computing device techniques and methods developed to facilitate device connectivity and device compatibility do not address the emphasis placed on security in the gaming industry.

To address some of the issues described above, a number of hardware/software components and architectures are utilized in EGMs that are not typically found in general purpose computing devices. These hardware/software components and architectures, as described below in more detail, include but are not limited to watchdog timers, voltage monitoring systems, state-based software architecture and supporting hardware, specialized communication interfaces, security monitoring, and trusted memory.

Certain EGMs use a watchdog timer to provide a software failure detection mechanism. In a normally-operating EGM, the operating software periodically accesses control registers in the watchdog timer subsystem to "re-trigger" the watchdog. Should the operating software fail to access the control registers within a preset timeframe, the watchdog timer will timeout and generate a system reset. Typical watchdog timer circuits include a loadable timeout counter register to enable the operating software to set the timeout interval within a certain range of time. A differentiating feature of some circuits is that the operating software cannot completely disable the function of the watchdog timer. In other words, the watchdog timer always functions from the time power is applied to the board.

Certain EGMs use several power supply voltages to operate portions of the computer circuitry. These can be generated in a central power supply or locally on the computer board. If any of these voltages falls out of the tolerance limits of the circuitry they power, unpredictable operation of the EGM may result. Though most modern general purpose computing devices include voltage monitoring circuitry, these types of circuits only report voltage status to the operating software. Out of tolerance voltages can cause software malfunction, creating a potential uncontrolled condition in the general purpose computing device. Certain EGMs have power supplies with relatively tighter voltage margins than that required by the operating circuitry. In addition, the voltage monitoring circuitry implemented in certain EGMs typically has two thresholds of control. The first threshold generates a software event that can be detected by the operating software and an error condition then generated. This threshold is triggered when a power supply voltage falls out of the tolerance range of the power supply, but is still within the operating range of the circuitry. The second threshold is set when a power supply voltage falls out of the operating tolerance of the circuitry. In this case, the circuitry generates a reset, halting operation of the EGM.

As described above, certain EGMs are state-based machines. Different functions of the game provided by the EGM (e.g., bet, play, result, points in the graphical presentation, etc.) may be defined as a state. When the EGM moves a game from one state to another, the EGM stores critical data regarding the game software in a custom non-volatile memory subsystem. This ensures that the player's wager and credits are preserved and to minimize potential disputes in the event of a malfunction on the EGM. In general, the EGM does not advance from a first state to a second state until critical information that enables the first state to be reconstructed has been stored. This feature enables the EGM to recover operation to the current state of play in the event of a malfunction, loss of power, etc. that occurred just prior to the malfunction. In at least one embodiment, the EGM is configured to store such critical information using atomic transactions.

Generally, an atomic operation in computer science refers to a set of operations that can be combined so that they appear to the rest of the system to be a single operation with only two possible outcomes: success or failure. As related to data storage, an atomic transaction may be characterized as series of database operations which either all occur, or all do not occur. A guarantee of atomicity prevents updates to the database occurring only partially, which can result in data corruption.

To ensure the success of atomic transactions relating to critical information to be stored in the EGM memory before a failure event (e.g., malfunction, loss of power, etc.), memory that includes one or more of the following criteria be used: direct memory access capability; data read/write capability which meets or exceeds minimum read/write access characteristics (such as at least 5.08 Mbytes/sec (Read) and/or at least 38.0 Mbytes/sec (Write)). Memory devices that meet or exceed the above criteria may be referred to as "fault-tolerant" memory devices.

Typically, battery-backed RAM devices may be configured to function as fault-tolerant devices according to the above criteria, whereas flash RAM and/or disk drive memory are typically not configurable to function as fault-tolerant devices according to the above criteria. Accordingly, battery-backed RAM devices are typically used to preserve EGM critical data, although other types of non-volatile memory devices may be employed. These memory devices are typically not used in typical general purpose computing devices.

Thus, in at least one embodiment, the EGM is configured to store critical information in fault-tolerant memory (e.g., battery-backed RAM devices) using atomic transactions. Further, in at least one embodiment, the fault-tolerant memory is able to successfully complete all desired atomic transactions (e.g., relating to the storage of EGM critical information) within a time period of 200 milliseconds or less. In at least one embodiment, the time period of 200 milliseconds represents a maximum amount of time for which sufficient power may be available to the various EGM components after a power outage event has occurred at the EGM.

As described previously, the EGM may not advance from a first state to a second state until critical information that enables the first state to be reconstructed has been atomically stored. After the state of the EGM is restored during the play of a game of chance, game play may resume and the game may be completed in a manner that is no different than if the malfunction had not occurred. Thus, for example, when a malfunction occurs during a game of chance, the EGM may be restored to a state in the game of chance just prior to when the malfunction occurred. The restored state may include metering information and graphical information that was displayed on the EGM in the state prior to the malfunction. For example, when the malfunction occurs during the play of a card game after the cards have been dealt, the EGM may be restored with the cards that were previously displayed as part of the card game. As another example, a bonus game may be triggered during the play of a game of chance in which a player is required to make a number of selections on a video display screen. When a malfunction has occurred after the player has made one or more selections, the EGM may be restored to a state that shows the graphical presentation just prior to the malfunction including an indication of selections that have already been made by the player. In general, the EGM may be restored to any state in a plurality of states that occur in the game of chance that occurs while the game of chance is played or to states that occur between the play of a game of chance.

Game history information regarding previous games played such as an amount wagered, the outcome of the game, and the like may also be stored in a non-volatile memory device. The information stored in the non-volatile memory may be detailed enough to reconstruct a portion of the graphical presentation that was previously presented on the EGM and the state of the EGM (e.g., credits) at the time the game of chance was played. The game history information may be utilized in the event of a dispute. For example, a player may decide that in a previous game of chance that they did not receive credit for an award that they believed they won. The game history information may be used to reconstruct the state of the EGM prior to, during, and/or after the disputed game to demonstrate whether the player was correct or not in her assertion. Examples of a state-based EGM, recovery from malfunctions, and game history are described in U.S. Pat. No. 6,804,763, entitled "High Performance Battery Backed RAM Interface"; U.S. Pat. No. 6,863,608, entitled "Frame Capture of Actual Game Play"; U.S. Pat. No. 7,111,141, entitled "Dynamic NV-RAM"; and U.S. Pat. No. 7,384,339, entitled, "Frame Capture of Actual Game Play."

Another feature of EGMs is that they often include unique interfaces, including serial interfaces, to connect to specific subsystems internal and external to the EGM. The serial devices may have electrical interface requirements that differ from the "standard" EIA serial interfaces provided by general purpose computing devices. These interfaces may include, for example, Fiber Optic Serial, optically coupled serial interfaces, current loop style serial interfaces, etc. In addition, to conserve serial interfaces internally in the EGM, serial devices may be connected in a shared, daisy-chain fashion in which multiple peripheral devices are connected to a single serial channel.

The serial interfaces may be used to transmit information using communication protocols that are unique to the gaming industry. For example, IGT's Netplex is a proprietary communication protocol used for serial communication between EGMs. As another example, SAS is a communication protocol used to transmit information, such as metering information, from an EGM to a remote device. Often SAS is used in conjunction with a player tracking system.

Certain EGMs may alternatively be treated as peripheral devices to a casino communication controller and connected in a shared daisy chain fashion to a single serial interface. In both cases, the peripheral devices are assigned device addresses. If so, the serial controller circuitry must implement a method to generate or detect unique device addresses. General purpose computing device serial ports are not able to do this.

Security monitoring circuits detect intrusion into an EGM by monitoring security switches attached to access doors in the EGM housing. Access violations result in suspension of game play and can trigger additional security operations to preserve the current state of game play. These circuits also function when power is off by use of a battery backup. In power-off operation, these circuits continue to monitor the access doors of the EGM. When power is restored, the EGM can determine whether any security violations occurred while power was off, e.g., via software for reading status registers. This can trigger event log entries and further data authentication operations by the EGM software.

Trusted memory devices and/or trusted memory sources are included in an EGM to ensure the authenticity of the software that may be stored on less secure memory subsystems, such as mass storage devices. Trusted memory devices and controlling circuitry are typically designed to not enable modification of the code and data stored in the memory device while the memory device is installed in the EGM. The code and data stored in these devices may include authentication algorithms, random number generators, authentication keys, operating system kernels, etc. The purpose of these trusted memory devices is to provide gaming regulatory authorities a root trusted authority within the computing environment of the EGM that can be tracked and verified as original. This may be accomplished via removal of the trusted memory device from the EGM computer and verification of the secure memory device contents is a separate third party verification device. Once the trusted memory device is verified as authentic, and based on the approval of the verification algorithms included in the trusted device, the EGM is enabled to verify the authenticity of additional code and data that may be located in the gaming computer assembly, such as code and data stored on hard disk drives. Examples of trusted memory devices are described in U.S. Pat. No. 6,685,567, entitled "Process Verification."

In at least one embodiment, at least a portion of the trusted memory devices/sources may correspond to memory that cannot easily be altered (e.g., "unalterable memory") such as EPROMS, PROMS, Bios, Extended Bios, and/or other memory sources that are able to be configured, verified, and/or authenticated (e.g., for authenticity) in a secure and controlled manner.

According to one embodiment, when a trusted information source is in communication with a remote device via a network, the remote device may employ a verification scheme to verify the identity of the trusted information source. For example, the trusted information source and the remote device may exchange information using public and private encryption keys to verify each other's identities. In another embodiment, the remote device and the trusted information source may engage in methods using zero knowledge proofs to authenticate each of their respective identities.

EGMs storing trusted information may utilize apparatuses or methods to detect and prevent tampering. For instance, trusted information stored in a trusted memory device may be encrypted to prevent its misuse. In addition, the trusted memory device may be secured behind a locked door. Further, one or more sensors may be coupled to the memory device to detect tampering with the memory device and provide some record of the tampering. In yet another example, the memory device storing trusted information might be designed to detect tampering attempts and clear or erase itself when an attempt at tampering has been detected. Examples of trusted memory devices/sources are described in U.S. Pat. No. 7,515,718, entitled "Secured Virtual Network in a Gaming Environment."

Mass storage devices used in a general purpose computing devices typically enable code and data to be read from and written to the mass storage device. In a gaming environment, modification of the gaming code stored on a mass storage device is strictly controlled and would only be enabled under specific maintenance type events with electronic and physical enablers required. Though this level of security could be provided by software, EGMs that include mass storage devices include hardware level mass storage data protection circuitry that operates at the circuit level to monitor attempts to modify data on the mass storage device and will generate both software and hardware error triggers should a data modification be attempted without the proper electronic and physical enablers being present. Examples of using a mass storage device are described in U.S. Pat. No. 6,149,522, entitled "Method of Authenticating Game Data Sets in an Electronic Casino Gaming System."

It should further be appreciated that the EGM of the present disclosure may have varying or alternative housing configurations.

It should further be appreciated that the EGM of the present disclosure may have varying or alternative display device configurations.

In various embodiments, the EGM of the present disclosure is configured to be positioned on a base or stand.

It should be appreciated that the enhanced physical player interaction provided by the present disclosure, in addition to being implemented in an EGM configured to be located on a casino floor, can be implemented in one or more personal gaming devices, such as desktop computers, laptop computers, tablet computers or computing devices, personal digital assistants, mobile phones, and other mobile computing devices.

Various changes and modifications to the present embodiments described herein will be apparent to those skilled in the art. Such changes and modifications can be made without departing from the spirit and scope of the present subject matter and without diminishing its intended advantages. It is therefore intended that such changes and modifications be covered by the appended claims.

We claim:

1. An electronic gaming machine comprising:
- a housing;
- a display device supported by the housing; and
- a player tactile feedback provider supported by the housing, the player feedback provider comprising:
  - a first ultrasonic transducer array assembly supported by the housing, the first ultrasonic transducer array assembly comprising:
    - a printed circuit board positioned such that a first plane perpendicular to a front face of the printed circuit board is oriented at a first acute angle with respect to a front face of the display device;
    - a transducer holder tray connected to the printed circuit board, the transducer holder tray comprising a plurality of inclined rows; and
    - first ultrasonic transducers supported by the transducer holder tray at a substantially equal distance from the printed circuit board, the first ultrasonic transducers angled away from the display device with respect to the printed circuit board, such that respective second planes perpendicular to a front face of each of the first ultrasonic transducers are at respective second acute angles with respect to the front surface of the display device, and wherein the respective second acute angles are larger than the first acute angle; and
  - a second ultrasonic transducer array supported by the housing, positioned in a spaced apart opposing position to the first ultrasonic transducer array assembly.

2. The electronic gaming machine of claim 1, wherein the transducer holder tray comprises a base and individual transducer holders connected to the base, and wherein the first ultrasonic transducers are supported by the individual transducer holders at the respective second acute angles relative to the front surface of the display device.

3. The electronic gaming machine of claim 1, wherein the transducer holder tray comprises a base and the inclined rows of individual transducer holders connected to the base, and wherein the first ultrasonic transducers are supported by the inclined rows of individual transducer holders at the respective second acute angles relative to the front surface of the display device and connected to the printed circuit board.

4. The electronic gaming machine of claim 1, wherein the first ultrasonic transducer array assembly is positioned below the display device, and wherein the second ultrasonic transducer array assembly is positioned above the display device in a spaced apart opposing position to the first ultrasonic transducer array assembly.

5. The electronic gaming machine of claim 1, wherein the first ultrasonic transducer array assembly and the second ultrasonic transducer array assembly are configured to direct sound waves into respective player tactile feedback zones that are partially overlapping.

6. The electronic gaming machine of claim 1, wherein the first ultrasonic transducer array assembly and the second ultrasonic transducer array assembly are configured to direct sound waves into respective player tactile feedback zones that are partially non-overlapping.

7. The electronic gaming machine of claim 1, which further comprises a hand position locator, a processor, and a memory device that stores a plurality of instructions, which when executed by the processor, cause the processor to:
- cause the display device to display a 3D image to a player without requiring the player to wear 3D glasses;
- operate with a hand position locator to determine a position of part of one of the player's hands in front of the display device; and
- responsive to the determined position being a same position as the 3D image, operate with the player tactile feedback provider to provide tactile feedback to said part of one of the player's hands.

8. The electronic gaming machine of claim 1, wherein the rows of individual transducer holders form a sawtooth pattern.

9. An electronic gaming machine comprising:
- a housing;
- a display device supported by the housing;
- a player hand position locator supported by the housing;
- a first ultrasonic transducer array assembly supported by the housing and comprising:
  - a first printed circuit board positioned such that a first plane perpendicular to a front face of the first printed circuit board is oriented at a first acute angle with respect to a front face of the display device;

a first transducer holder tray connected to the first printed circuit board, the first transducer holder tray comprising a plurality of inclined rows; and a plurality of first ultrasonic transducers supported by the first transducer holder tray at a substantially equal distance from the first printed circuit board, the plurality of first ultrasonic transducers angled away from the display device with respect to the first printed circuit board, such that respective second planes perpendicular to a front face of each of the plurality of first ultrasonic transducers are at respective second acute angles with respect to the front surface of the display device, and wherein the respective second acute angles are larger than the first acute angle; and a second ultrasonic transducer array assembly supported by the housing and comprising:

a second printed circuit board positioned such that a third plane perpendicular to a front face of the second printed circuit board is oriented at a third acute angle with respect to the front face of the display device;

a second transducer holder tray connected to the second printed circuit board, the second transducer holder tray comprising a plurality of inclined rows; and a plurality of second ultrasonic transducers supported by the second transducer holder tray at a substantially equal distance from the second printed circuit board, the plurality of second ultrasonic transducers angled away from the display device with respect to the second printed circuit board, such that respective fourth planes perpendicular to a front face of each of the plurality of second ultrasonic transducers are at respective fourth acute angles with respect to the front surface of the display device, and wherein the respective fourth acute angles are larger than the third acute angle.

10. The electronic gaming machine of claim 9, which comprises a processor and a memory device that stores a plurality of instructions, which when executed by the processor, cause the processor to:

cause the display device to display a 3D image to a player without requiring the player to wear 3D glasses;

operate with the hand position locator to determine a position of part of one of the player's hands in front of the display device; and responsive to the determined position being a same position as the 3D image, operate with the first ultrasonic transducer array assembly and the second ultrasonic transducer array assembly to provide tactile feedback to said part of one of the player's hands.

11. An electronic gaming machine comprising:

a housing;

a display device supported by the housing;

a first ultrasonic transducer array assembly supported by the housing and comprising:

a first printed circuit board positioned such that a first plane perpendicular to a front face of the first printed circuit board is oriented at a first acute angle with respect to a front face of the display device;

a first transducer holder tray connected to the first printed circuit board, the first transducer holder tray comprising a plurality of inclined rows; and a plurality of first ultrasonic transducers each supported by the first transducer holder tray at a substantially equal distance from the first printed circuit board, the plurality of first ultrasonic transducers angled away from the display device with respect to the first printed circuit board, such that respective second planes perpendicular to a front face of each of the plurality of first ultrasonic transducers are at respective second acute angles with respect to the front surface of the display device, and wherein the respective second acute angles are larger than the first acute angle; and a second ultrasonic transducer array assembly supported by the housing and comprising:

a second printed circuit board positioned such that a third plane perpendicular to a front face of the second printed circuit board is oriented at a third acute angle with respect to the front face of the display device;

a second transducer holder tray connected to the second printed circuit board, the second transducer holder tray comprising a plurality of inclined rows; and a plurality of second ultrasonic transducers each supported by the second transducer holder tray at a substantially equal distance from the second printed circuit board, the plurality of second ultrasonic transducers angled away from the display device with respect to the second printed circuit board, such that respective fourth planes perpendicular to a front face of each of the plurality of second ultrasonic transducers are at respective fourth acute angles with respect to the front surface of the display device, and wherein the respective fourth acute angles are larger than the third acute angle.

12. The electronic gaming machine of claim 11, wherein the first ultrasonic transducer array assembly and the second ultrasonic transducer array assembly are configured to direct sound waves into respective player tactile feedback zones that are partially overlapping in front of and spaced apart a designated distance from the display device, the designated distance based on a 3D object display area in front of the display device.

13. The electronic gaming machine of claim 12, wherein the first ultrasonic transducer array assembly and the second ultrasonic transducer array assembly are configured to direct sound waves into respective player tactile feedback zones that are partially non-overlapping in front of and spaced apart a designated distance from the display device, the designated distance based on a 3D object display area in front of the display device.

* * * * *